US010119085B2

(12) United States Patent
Roeger-Goepfert et al.

(10) Patent No.: US 10,119,085 B2
(45) Date of Patent: Nov. 6, 2018

(54) QUATERNIZED NITROGEN COMPOUNDS AND USE THEREOF AS ADDITIVES IN FUELS AND LUBRICANTS

(71) Applicant: BASF SE, Ludwigshafen (DE)

(72) Inventors: Cornelia Roeger-Goepfert, Weinheim (DE); Harald Boehnke, Mannheim (DE); Wolfgang Grabarse, Mannheim (DE); Hannah Maria Koenig, Mannheim (DE); Markus Hansch, Speyer (DE); Ludwig Voelkel, Limburgerhof (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 15/918,201

(22) Filed: Mar. 12, 2018

(65) Prior Publication Data

US 2018/0201856 A1 Jul. 19, 2018

Related U.S. Application Data

(62) Division of application No. 14/621,421, filed on Feb. 13, 2015, now Pat. No. 9,951,285, which is a division of application No. 13/535,847, filed on Jun. 28, 2012, now abandoned.

(60) Provisional application No. 61/501,860, filed on Jun. 28, 2011.

(51) Int. Cl.

| | |
|---|---|
| ***C10L 1/22*** | (2006.01) |
| ***C10L 10/14*** | (2006.01) |
| ***C10L 10/04*** | (2006.01) |
| ***C10L 10/06*** | (2006.01) |
| ***C10L 1/2383*** | (2006.01) |
| ***C10M 133/58*** | (2006.01) |

(52) U.S. Cl.

CPC ..... *C10L 1/221* (2013.01); *C10L 1/2383* (2013.01); *C10L 10/04* (2013.01); *C10L 10/06* (2013.01); *C10L 10/14* (2013.01); *C10M 133/58* (2013.01); *C10L 2200/0259* (2013.01); *C10L 2270/023* (2013.01); *C10L 2270/026* (2013.01); *C10M 2215/28* (2013.01); *C10N 2230/04* (2013.01); *C10N 2270/00* (2013.01)

(58) Field of Classification Search

CPC combination set(s) only.
See application file for complete search history.

(56) References Cited

U.S. PATENT DOCUMENTS

| | | | |
|---|---|---|---|
| 4,171,959 | A | 10/1979 | Vartanian |
| 4,248,719 | A | 2/1981 | Chafetz et al. |
| 4,491,455 | A | 1/1985 | Ishizaki et al. |
| 4,877,416 | A | 10/1989 | Campbell |
| 6,743,266 | B2 | 6/2004 | Derosa et al. |
| 2011/0201772 | A1 | 8/2011 | König et al. |
| 2011/0258917 | A1 | 10/2011 | Garcia Castro et al. |
| 2011/0288322 | A1 | 11/2011 | Garcia et al. |
| 2011/0315107 | A1 | 12/2011 | Grabarse et al. |
| 2012/0010112 | A1 | 1/2012 | Grabarse et al. |
| 2012/0118750 | A1 | 5/2012 | Roeger-Goepfert et al. |
| 2012/0128611 | A1 | 5/2012 | Grumelard et al. |
| 2012/0128888 | A1 | 5/2012 | Roeger-Goepfert et al. |
| 2012/0137573 | A1 | 6/2012 | Völkel et al. |
| 2012/0142868 | A1 | 6/2012 | König et al. |
| 2012/0144731 | A1 | 6/2012 | Böhnke |
| 2012/0149617 | A1 | 6/2012 | Lange et al. |
| 2012/0165473 | A1 | 6/2012 | Koenig et al. |
| 2012/0178824 | A1 | 7/2012 | König et al. |
| 2012/0208971 | A1 | 8/2012 | König et al. |
| 2012/0222348 | A1 | 9/2012 | Böhnke |
| 2012/0271003 | A1 | 10/2012 | König et al. |
| 2012/0292193 | A1 | 11/2012 | Roeger-Goepfert et al. |
| 2013/0233267 | A1 | 9/2013 | Barbour |

FOREIGN PATENT DOCUMENTS

| | | | |
|---|---|---|---|
| DE | 38 26 608 | A1 | 2/1990 |
| DE | 38 38 918 | A1 | 5/1990 |
| DE | 41 42 241 | A1 | 6/1993 |
| DE | 43 09 074 | A1 | 9/1994 |
| DE | 43 19 672 | A1 | 12/1994 |
| DE | 196 20 262 | A1 | 11/1997 |
| DE | 101 02 913 | A1 | 7/2002 |
| EP | 0 061 895 | A2 | 10/1982 |
| EP | 0 244 616 | A2 | 11/1987 |
| EP | 0 261 957 | A2 | 3/1988 |
| EP | 0 307 815 | A1 | 3/1989 |
| EP | 0 310 875 | A1 | 4/1989 |
| EP | 0 356 725 | A1 | 3/1990 |
| EP | 0 452 328 | | 10/1991 |
| EP | 0 476 485 | A1 | 3/1992 |
| EP | 0 548 617 | A2 | 6/1993 |

(Continued)

OTHER PUBLICATIONS

International Search Report as received in the International Patent Application PCT/EP2012/062553 dated Nov. 30, 2012.

(Continued)

*Primary Examiner* — Ellen M McAvoy
*Assistant Examiner* — Chantel L Graham
(74) *Attorney, Agent, or Firm* — Oblon, McClelland, Maier & Neustadt, L.L.P.

(57) ABSTRACT

The present invention relates to novel quaternized nitrogen compounds, to the preparation thereof and to the use thereof as a fuel and lubricant additive, more particularly as a detergent additive; to additive packages which comprise these compounds; and to fuels and lubricants thus additized. The present invention further relates to the use of these quaternized nitrogen compounds as a fuel additive for reducing or preventing deposits in the injection systems of direct-injection diesel engines, especially in common-rail injection systems, for reducing the fuel consumption of direct-injection diesel engines, especially of diesel engines with common-rail injection systems, and for minimizing power loss in direct-injection diesel engines, especially in diesel engines with common-rail injection systems.

14 Claims, No Drawings

(56) References Cited

FOREIGN PATENT DOCUMENTS

| | | | |
|---|---|---|---|
| EP | 0 629 638 | | 12/1994 |
| EP | 0 639 632 | A1 | 2/1995 |
| EP | 0 700 985 | A1 | 3/1996 |
| EP | 0 831 141 | A1 | 3/1998 |
| EP | 2 033 945 | A1 | 3/2009 |
| EP | 2 540 808 | | 1/2013 |
| WO | WO 87/01126 | | 2/1987 |
| WO | 87/03003 | | 5/1987 |
| WO | WO 91/03529 | | 3/1991 |
| WO | WO 93/18115 | | 9/1993 |
| WO | WO 94/24231 | | 10/1994 |
| WO | WO 96/03367 | | 2/1996 |
| WO | WO 96/03479 | | 2/1996 |
| WO | WO 97/03946 | | 2/1997 |
| WO | WO 98/04656 | | 2/1998 |
| WO | WO 99/29748 | | 6/1999 |
| WO | WO 00/44857 | | 8/2000 |
| WO | WO 00/47698 | | 8/2000 |
| WO | WO 2004/035715 | A1 | 4/2004 |
| WO | WO 2005/054314 | A2 | 6/2005 |
| WO | 2006/135881 | | 12/2006 |
| WO | WO 2006/135881 | A2 | 12/2006 |
| WO | WO 2008/138836 | A2 | 11/2008 |
| WO | 2011/095819 | | 8/2011 |
| WO | 2011/110860 | | 9/2011 |
| WO | 2011/141731 | | 11/2011 |

OTHER PUBLICATIONS

Opposition as received in the corresponding European Patent Application No. 0000071427EP02 dated Feb. 1, 2017.
Glissapol Technical Information , (Dec. 2005), pp. 1-8.

QUATERNIZED NITROGEN COMPOUNDS AND USE THEREOF AS ADDITIVES IN FUELS AND LUBRICANTS

This application is a divisional application of U.S. application Ser. No. 14/621,421 filed Feb. 13, 2015, allowed, which is a divisional application of U.S. Ser. No. 13/535,847 filed Jun. 28, 2012, abandoned, and claims the benefit of U.S. Ser. No. 61/501,860 filed Jun. 28, 2011.

The present invention relates to novel quaternized nitrogen compounds, to the preparation thereof and to the use thereof as a fuel and lubricant additive, more particularly as a detergent additive, to additive packages which comprise these compounds; and to fuels and lubricants thus additized. The present invention further relates to the use of these quaternized nitrogen compounds as a fuel additive for reducing or preventing deposits in the injection systems of direct-injection diesel engines, especially in common-rail injection systems, for reducing the fuel consumption of direct-injection diesel engines, especially of diesel engines with common-rail injection systems, and for minimizing power loss in direct-injection diesel engines, especially in diesel engines with common-rail injection systems.

STATE OF THE ART

In direct-injection diesel engines, the fuel is injected and distributed ultrafinely (nebulized) by a multihole injection nozzle which reaches directly into the combustion chamber of the engine, instead of being introduced into a prechamber or swirl chamber as in the case of the conventional (chamber) diesel engine. The advantage of the direct-injection diesel engines lies in their high performance for diesel engines and nevertheless low fuel consumption. Moreover, these engines achieve a very high torque even at low speeds.

At present, essentially three methods are being used to inject the fuel directly into the combustion chamber of the diesel engine: the conventional distributor injection pump, the pump-nozzle system (unit-injector system or unit-pump system) and the common-rail system.

In the common-rail system, the diesel fuel is conveyed by a pump with pressures up to 2000 bar into a high-pressure line, the common rail. Proceeding from the common rail, branch lines run to the different injectors which inject the fuel directly into the combustion chamber. The full pressure is always applied to the common rail, which enables multiple injection or a specific injection form. In the other injection systems, in contrast, only smaller variation in the injection is possible. The injection in the common rail is divided essentially into three groups: (1.) pre-injection, by which essentially softer combustion is achieved, such that harsh combustion noises ("nailing") are reduced and the engine seems to run quietly; (2.) main injection, which is responsible especially for a good torque profile; and (3.) post-injection, which especially ensures a low $NO_x$ value. In this post-injection, the fuel is generally not combusted, but instead evaporated by residual heat in the cylinder. The exhaust gas/fuel mixture formed is transported to the exhaust gas system, where the fuel, in the presence of suitable catalysts, acts as a reducing agent for the nitrogen oxides $NO_R$.

The variable, cylinder-individual injection in the common-rail injection system can positively influence the pollutant emission of the engine, for example the emission of nitrogen oxides ($NO_x$), carbon monoxide (CO) and especially of particulates (soot). This makes it possible, for example, that engines equipped with common-rail injection systems can meet the Euro 4 standard theoretically even without additional particulate filters.

In modern common-rail diesel engines, under particular conditions, for example when biodiesel-containing fuels or fuels with metal impurities such as zinc compounds, copper compounds, lead compounds and other metal compounds are used, deposits can form on the injector orifices, which adversely affect the injection performance of the fuel and hence impair the performance of the engine, i.e. especially reduce the power, but in some cases also worsen the combustion. The formation of deposits is enhanced further by further developments in the injector construction, especially by the change in the geometry of the nozzles (narrower, conical orifices with rounded outlet). For lasting optimal functioning of engine and injectors, such deposits in the nozzle orifices must be prevented or reduced by suitable fuel additives.

In the injection systems of modern diesel engines, deposits cause significant performance problems. It is common knowledge that such deposits in the spray channels can lead to a decrease in the fuel flow and hence to power loss. Deposits at the injector tip, in contrast, impair the optimal formation of fuel spray mist and, as a result, cause worsened combustion and associated higher emissions and increased fuel consumption. In contrast to these conventional "external" deposition phenomena, "internal" deposits (referred to collectively as internal diesel injector deposits (IDID)) in particular parts of the injectors, such as at the nozzle needle, at the control piston, at the valve piston, at the valve seat, in the control unit and in the guides of these components, also increasingly cause performance problems. Conventional additives exhibit inadequate action against these IDIDs.

U.S. Pat. No. 4,248,719 describes quaternized ammonium salts which are prepared by reacting an alkenylsuccinimide with a monocarboxylic ester and find use as dispersants in lubricant oils for prevention of sludge formation. More particularly, for example, the reaction of polyisobutylsuccinic anhydride (PIBSA) with N,N-dimethylaminopropylamine (DMAPA) and quaternization with methyl salicylate is described. However, use in fuels, more particularly diesel fuels, is not proposed therein. The use of PIBSA with low bismaleation levels of <20% is not described therein.

U.S. Pat. No. 4,171,959 describes quaternized ammonium salts of hydrocarbyl-substituted succinimides, which are suitable as detergent additives for gasoline fuel compositions. For quaternization, preference is given to using alkyl halides. Also mentioned are organic $C_2$-$C_8$-hydrocarbyl carboxylates and sulfonates. Consequently, the quaternized ammonium salts provided according to the teaching therein have, as a counterion, either a halide or a $C_2$-$C_8$-hydrocarbyl carboxylate or a $C_2$-$C_8$-hydrocarbyl sulfonate group. The use of PIBSA with low bismaleation levels of <20% is likewise not described therein.

EP-A-2 033 945 discloses cold flow improvers which are prepared by quaternizing specific tertiary monoamines bearing at least one $C_8$-$C_{40}$-alkyl radical with a $C_1$-$C_4$-alkyl ester of specific carboxylic acids. Examples of such carboxylic esters are dimethyl oxalate, dimethyl maleate, dimethyl phthalate and dimethyl fumarate. Applications other than that of improving the CFPP value of middle distillates are not demonstrated in EP-A-2 033 945.

WO 2006/135881 describes quaternized ammonium salts prepared by condensation of a hydrocarbyl-substituted acylating agent and of an oxygen or nitrogen atom-containing compound with a tertiary amino group, and subsequent quaternization by means of hydrocarbyl epoxide in the presence of stoichiometric amounts of an acid, especially acetic acid. Further quaternizing agents claimed in WO 2006/135881 are dialkyl sulfates, benzyl halides and hydrocarbyl-substituted carbonates, and dimethyl sulfate, benzyl chloride and dimethyl carbonate have been studied experimentally.

The quaternizing agents used with preference in WO 2006/135881, however, have serious disadvantages such as: toxicity or carcinogenicity (for example in the case of dimethyl sulfate and alkylene oxides and benzyl halides), no residue-free combustion (for example in the case of dimethyl sulfate and alkyl halides), and inadequate reactivity which leads to incomplete quaternization or uneconomic reaction conditions (long reaction times, high reaction temperatures, excess of quaternizing agent; for example in the case of dimethyl carbonate).

It was therefore an object of the present invention to provide improved quaternized fuel additives, especially based on hydrocarbyl-substituted polycarboxylic acid compounds, which no longer have the disadvantages of the prior art mentioned.

BRIEF DESCRIPTION OF THE INVENTION

It has now been found that, surprisingly, the above object is achieved by providing specific quaternized nitrogen compounds and fuel and lubricant compositions additized therewith.

Surprisingly, the inventive additives thus prepared are superior in several ways to the prior art additives prepared in a conventional manner: they have low toxicity (caused by the specific selection of the quaternizing agent, burn ashlessly, exhibit a high content of quaternized product, and allow an economic reaction regime in the preparation thereof, and surprisingly have improved handling properties, such as especially improved solubility, such as especially in diesel performance additive packages. At the same time, the inventive additives exhibit improved action with regard to prevention of deposits in diesel engines, as especially illustrated by the use examples appended.

DETAILED DESCRIPTION OF THE INVENTION

A1) Specific Embodiments

The present invention relates especially to the following specific embodiments:

1. A fuel or lubricant composition, especially fuel composition, comprising, in a majority of a customary fuel or lubricant, a proportion (especially an effective amount) of at least one reaction product comprising a quaternized nitrogen compound (or a fraction thereof which comprises a quaternized nitrogen compound and is obtained from the reaction product by purification), said reaction product being obtainable by a. reacting a high molecular weight hydrocarbyl-substituted polycarboxylic acid compound with a compound comprising at least one oxygen or nitrogen group reactive (especially capable of addition or condensation) with the polycarboxylic acid, and comprising at least one quaternizable amino group, to obtain a quaternizable hydrocarbyl-substituted polycarboxylic acid compound (by addition or condensation), and b. subsequent reaction thereof with a quaternizing agent which converts the at least one hereafter quaternizable, for example tertiary, amino group to a quaternary ammonium group, said quaternizing agent being the alkyl ester of a cycloaromatic or cycloaliphatic mono- or polycarboxylic acid (especially of a mono- or dicarboxylic acid) or of an aliphatic polycarboxylic acid (especially dicarboxylic acid).

2. A fuel or lubricant composition, especially fuel composition, comprising, in a majority of a customary fuel or lubricant, a proportion (especially an effective amount) of at least one reaction product comprising a quaternized nitrogen compound (or a fraction thereof which comprises a quaternized nitrogen compound and is obtained from the reaction product by purification), said reaction product being obtainable by reacting a quaternizable high molecular weight hydrocarbyl-substituted polycarboxylic acid compound comprising at least one quaternizable amino group with a quaternizing agent which converts the at least one hereafter quaternizable, for example tertiary, amino group to a quaternary ammonium group, said quaternizing agent being the alkyl ester of a cycloaromatic or cycloaliphatic mono- or polycarboxylic acid (especially of a mono- or dicarboxylic acid) or of an aliphatic polycarboxylic acid (especially dicarboxylic acid).

3. The fuel composition according to either of the preceding claims, wherein about 1.1 to about 2.0 or about 1.25 to about 2.0 equivalents, for example 1.3, 1.4, 1.5, 1.6, 1.7, 1.8 or 1.9 equivalents, of quaternizing agent are used per equivalent of quaternizable tertiary nitrogen atom. By increasing the proportion of quaternizing agent within the range claimed, distinct improvements in product yields can be achieved.

4. The fuel composition according to any of the preceding claims, wherein the hydrocarbyl-substituted polycarboxylic acid compound is a polyisobutenylsuccinic acid or an anhydride thereof, said acid having a bismaleation level of equal to or less than about 20% or equal to or less than about 15%, for example 15, 14, 13, 12, 11, 10, 9, 8, 7, 6, 5, 4, 3, 2, 1 or 0.1%.

Lower levels of bismaleation can contribute to a distinct improvement in the solubility of the additive and/or compatibility of the constituents in the formulation of additive packages.

5. The fuel or lubricant composition, especially fuel composition, according to any of the preceding embodiments, wherein the quaternizing agent is a compound of the general formula 1

$$R_1OC(O)R_2 \quad (1)$$

in which $R_1$ is a low molecular weight hydrocarbyl radical, such as alkyl or alkenyl radical, especially a lower alkyl radical, such as especially methyl or ethyl, and $R_2$ is an optionally substituted monocyclic hydrocarbyl radical, especially an aryl or cycloalkyl or cycloalkenyl radical, especially aryl such as phenyl, where the substituent is selected from OH, $NH_2$, $NO_2$, $C(O)OR_3$, and $R_1OC(O)$—, in which $R_1$ is as defined above and $R_3$ is H or $R_1$, where the substituent is especially OH. More particularly, the quaternizing agent is a phthalate or a salicylate, such as dimethyl phthalate or methyl salicylate.

6. The fuel or lubricant composition, especially fuel composition, according to any of the preceding embodiments, wherein the quaternizing agent is a compound of the general formula 2

$$R_1OC(O)\text{-}A\text{-}C(O)OR_{1a} \quad (2)$$

in which $R_1$ and $R_{1a}$ are each independently a low molecular weight hydrocarbyl radical, such as an alkyl or alkenyl radical, especially a lower alkyl radical and A is hydrocarbylene (such as especially $C_1$-$C_7$-alkylene or $C_2$-$C_7$-alkenylene).

7. The fuel or lubricant composition, especially fuel composition, according to any of the preceding embodiments, wherein the quaternized nitrogen compound has a number-average molecular weight in the range from 400 to 5000, especially 800 to 3000 or 900 to 1500.

8. The fuel or lubricant composition, especially fuel composition, according to any of the preceding embodiments, wherein the quaternizing agent is selected from alkyl salicylates, dialkyl phthalates and dialkyl oxalates; particular mention should be made of alkyl salicylates, especially lower alkyl salicylates, such as methyl, ethyl and n-propyl salicylates.

9. The fuel or lubricant composition, especially fuel composition, according to embodiment 1, wherein the compound which is reactive (capable of addition or condensation) with the polycarboxylic acid and comprises an oxygen or nitrogen group and at least one quaternizable amino group is selected from a. hydroxyalkyl-substituted mono- or polyamines having at least one quaternizable primary, secondary or tertiary amino group;

b. straight-chain or branched, cyclic, heterocyclic, aromatic or nonaromatic polyamines having at least one primary or secondary amino group and having at least one quaternizable primary, secondary or tertiary amino group;

c. piperazines, and particular mention should be made of group a.

10. The fuel or lubricant composition according to embodiment 9, wherein the compound which is reactive, especially capable of addition or condensation, with the polycarboxylic acid and comprises an oxygen or nitrogen group and at least one quaternizable amino group is selected from a. hydroxyalkyl-substituted primary, secondary or tertiary monoamines and hydroxyalkyl-substituted primary, secondary or tertiary diamines, b. straight-chain or branched aliphatic diamines having two primary amino groups; di- or polyamines having at least one primary and at least one secondary amino group; di- or polyamines having at least one primary and at least one tertiary amino group; aromatic carbocyclic diamines having two primary amino groups; aromatic heterocyclic polyamines having two primary amino groups; aromatic or nonaromatic heterocycles having one primary and one tertiary amino group;

and particular mention should be made of group a.

11. The fuel composition according to any of the preceding embodiments, selected from diesel fuels, biodiesel fuels, gasoline fuels and alkanol-containing gasoline fuels.

12. The fuel or lubricant composition, especially fuel composition, according to any of the preceding embodiments, wherein the hydrocarbyl-substituted polycarboxylic acid compound is a polyisobutenylsuccinic acid or an anhydride (PIBSA) thereof, said acid having a low bismaleation level, especially 10% or less than 10%, for example 2 to 9 or 3 to 7%. More particularly, such PIBSAs are derived from HR-PIB with an Mn in the range from about 400 to 3000.

More particularly, the above compositions are fuel compositions, in particular diesel fuels.

13. The reaction product obtainable by a process as defined in any of the preceding embodiments, especially according to embodiment 3, 4, 5, 6 and in particular embodiment 8, 9 or 10, or quaternized nitrogen compound obtained from the reaction product by partial or full purification.

In a particular configuration (A) of the invention, quaternized reaction products which are prepared proceeding from polyisobutenylsuccinic acid or an anhydride thereof are provided, this compound having a bismaleation level of equal to or less than about 20% or equal to or less than about 15%, for example 15, 14, 13, 12, 11, 10, 9, 8, 7, 6, 5, 4, 3, 2, 1, or 0.1%. This polyisobutenylsuccinic acid compound is reacted (especially by addition or condensation) with a compound comprising at least one oxygen or nitrogen group reactive (addable or condensable) with the polyisobutenylsuccinic acid compound and containing at least one quaternizable amino group, and then quaternized.

In a particular configuration (B) of the invention, quaternized reaction products which are obtained by quaternization using an excess of quaternizing agent are provided. More particularly, about 1.1 to about 2.0 or about 1.25 to about 2.0 equivalents, for example 1.3, 1.4, 1.5, 1.6, 1.7, 1.8 or 1.9, equivalents of quaternizing agent are used per equivalent of quaternizable tertiary nitrogen atoms. Particularly useful quaternizing agents are those of the formula (1), especially the lower alkyl esters of salicylic acid, such as methyl salicylate, ethyl salicylate, n- and i-propyl salicylate, and n-, i- or tert-butyl salicylate.

In a further particular configuration (C), configurations (A) and (B) are combined, i.e. the quaternizable compounds prepared from the above polyisobutenylsuccinic acid compounds according to configuration (A) are quaternized according to configuration (B).

14. A process for preparing a quaternized nitrogen compound according to embodiment 13, comprising the reaction of a quaternizable hydrocarbyl-substituted polycarboxylic acid compound comprising at least one tertiary quaternizable amino group with a quaternizing agent which converts the at least one tertiary amino group to a quaternary ammonium group, said quaternizing agent being the alkyl ester of a cycloaromatic or cycloaliphatic mono- or polycarboxylic acid (especially of a mono- or dicarboxylic acid) or of an aliphatic polycarboxylic acid (especially dicarboxylic acid).

15. The use of a reaction product or of a quaternized nitrogen compound according to embodiment 13 or of a compound prepared according to embodiment 14 as a fuel additive or lubricant additive, especially fuel additive, especially diesel fuel additive.

16. The use according to embodiment 15 as an additive for reducing the fuel consumption of direct-injection diesel engines, especially of diesel engines with common-rail injection systems, as determined, for example, in an XUD9 test to CEC-F-23-01, and/or for minimizing power loss in direct-injection diesel engines, especially in diesel engines with common-rail injection systems, as determined, for example, in a DW10 test based on CEC-F-098-08.

17. The use according to embodiment 15 as a gasoline fuel additive for reducing the level of deposits in the intake system of a gasoline engine, such as especially DISI (direct injection spark ignition) and PFI (port fuel injector) engines.

18. The use according to embodiment 15 as a diesel fuel additive, especially as a cold flow improver, as a wax antisettling additive (WASA) or as an additive for reducing the level of and/or preventing deposits in the intake systems, such as especially the internal diesel injector deposits (IDIDs), and/or valve sticking in direct-injection diesel engines, especially in common-rail injection systems.

19. An additive concentrate comprising, in combination with further diesel fuel or gasoline fuel additives, especially diesel fuel additives, at least one quaternized nitrogen compound as defined in embodiment 13 or prepared according to embodiment 14.

A2) General Definitions

A "condensation" or "condensation reaction" in the context of the present invention describes the reaction of two molecules with elimination of a relatively small molecule, especially of a water molecule. When such an elimination is not detectable analytically, more particularly not detectable in stoichiometric amounts, and the two molecules react nevertheless, for example with addition, the reaction in question of the two molecules is "without condensation".

In the absence of statements to the contrary, the following general conditions apply:

"Hydrocarbyl" can be interpreted widely and comprises both long-chain and short-chain, straight-chain and branched hydrocarbon radicals, which may optionally additionally comprise heteroatoms, for example O, N, NH, S, in the chain thereof.

"Long-chain" or "high molecular weight" hydrocarbyl radicals have a number-average molecular weight ($M_n$) of 85 to 20 000, for example 113 to 10 000, or 200 to 10 000 or 350 to 5000, for example 350 to 3000, 500 to 2500, 700 to 2500, or 800 to 1500. More particularly, they are formed essentially from $C_{2-6}$, especially $C_{2-4}$, monomer units such as ethylene, propylene, n- or isobutylene or mixtures thereof, where the different monomers may be copolymerized in random distribution or as blocks. Such long-chain hydrocarbyl radicals are also referred to as polyalkylene radicals or poly-$C_{2-6}$- or poly-$C_{2-4}$-alkylene radicals. Suitable long-chain hydrocarbyl radicals and the preparation thereof are also described, for example, in WO 2006/135881 and the literature cited therein.

Examples of particularly useful polyalkylene radicals are polyisobutenyl radicals derived from "high-reactivity" polyisobutenes (HR-PIB) which are notable for a high content of terminal double bonds (cf., for example, also Rath et al., Lubrication Science (1999), 11-2, 175-185). Terminal double bonds are alpha-olefinic double bonds of the type

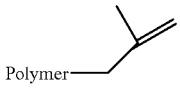

which are also referred to collectively as vinylidene double bonds. Suitable high-reactivity polyisobutenes are, for example, polyisobutenes which have a proportion of vinylidene double bonds of greater than 70 mol %, especially greater than 80 mol % or greater than 85 mol %. Preference is given especially to polyisobutenes which have homogeneous polymer structures. Homogeneous polymer structures are possessed especially by those polyisobutenes formed from isobutene units to an extent of at least 85% by weight, preferably to an extent of at least 90% by weight and more preferably to an extent of at least 95% by weight. Such high-reactivity polyisobutenes preferably have a number-average molecular weight within the abovementioned range. In addition, the high-reactivity polyisobutenes may have a polydispersity in the range from 1.05 to 7, especially of about 1.1 to 2.5, for example of less than 1.9 or less than 1.5. Polydispersity is understood to mean the quotient of weight-average molecular weight Mw divided by the number-average molecular weight Mn.

Particularly suitable high-reactivity polyisobutenes are, for example, the Glissopal brands from BASF SE, especially Glissopal® 1000 (Mn=1000), Glissopal® V 33 (Mn=550), Glissopal® 1300 (Mn=1300) and Glissopal® 2300 (Mn=2300), and mixtures thereof. Other number-average molecular weights can be established in a manner known in principle by mixing polyisobutenes of different number-average molecular weights or by extractive enrichment of polyisobutenes of particular molecular weight ranges.

PIBSA is prepared in a manner known in principle by reacting PIB with maleic anhydride (MAA), in principle forming a mixture of PIBSA and bismaleated PIBSA (BM PIBSA, cf. scheme 1, below), which is generally not separated but used as such in further reactions. The ratio of the two components to one another can be reported via the "bismaleation level" (BML). The BML is known per se (see also U.S. Pat. No. 5,883,196). The BML can also be determined by the following formula:

$$BML=100\%\times[(\text{wt-\% (BM PIBSA)})/(\text{wt-\% (BM PIBSA)}+\text{wt-\% (PIBSA)})]$$

where wt-% (X) represents the proportion by weight of component X (X=PIBSA or BM PIBSA) in the reaction product of PIB with MSA.

Scheme 1

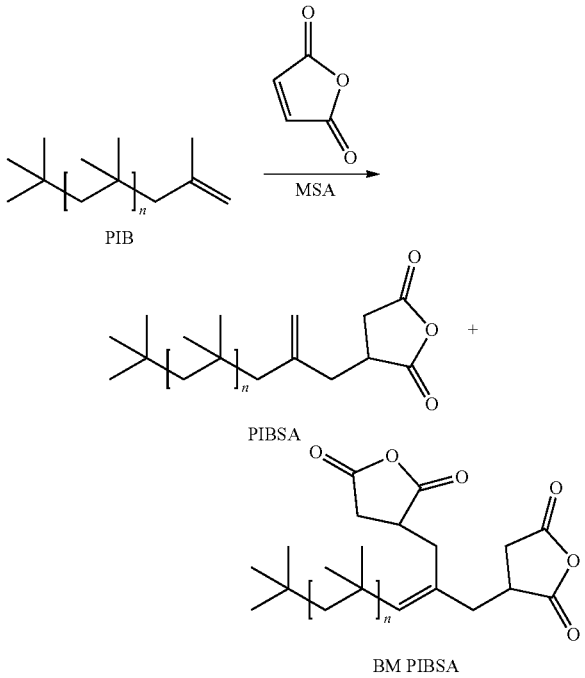

Hydrocarbyl-substituted polycarboxylic acid compound with a "low bismaleation level", especially corresponding polyisobutenylsuccinic acids or anhydrides thereof (also referred to overall as PIBSA) are known from the prior art. Especially advantageous are bismaleation levels of 20% or less, or 15% or less, for example 14, 13, 12 or 10%; or 10% or less, for example 2-9, 3-8, 4-7, 5 or 6%. The controlled preparation thereof is described, for example, in U.S. Pat. No. 5,883,196. Suitable for preparation thereof are especially the above high-reactivity polyisobutenes with an Mn in the range from about 500 to 2500, for example 550 to 3000, 1000 to 2000 or 1000 to 1500.

A nonlimiting example of a corresponding PIBSA is Glissopal® SA, derived from HR-PIB (Mn=1000), with a bismaleation level of 9%.

"Short-chain hydrocarbyl" or "low molecular weight hydrocarbyl" is especially straight-chain or branched alkyl or alkenyl, optionally interrupted by one or more, for example 2, 3 or 4, heteroatom groups such as —O— or —NH—, or optionally mono- or polysubstituted, for example di-, tri- or tetrasubstituted.

"Alkyl" or "lower alkyl" represents especially saturated, straight-chain or branched hydrocarbon radicals having 1 to 4, 1 to 6, 1 to 8, or 1 to 10 or 1 to 20, carbon atoms, for example methyl, ethyl, n-propyl, 1-methylethyl, n-butyl, 1-methylpropyl, 2-methylpropyl, 1,1-dimethylethyl, n-pentyl, 1-methylbutyl, 2-methylbutyl, 3-methylbutyl, 2,2-dimethylpropyl, 1-ethylpropyl, n-hexyl, 1,1-dimethylpropyl, 1,2-dimethylpropyl, 1-methylpentyl, 2-methylpentyl, 3-methylpentyl, 4-methylpentyl, 1,1-dimethylbutyl, 1,2-dimethylbutyl, 1,3-dimethylbutyl, 2,2-dimethylbutyl, 2,3-dimethylbutyl, 3,3-dimethylbutyl, 1-ethylbutyl, 2-ethylbutyl, 1,1,2-trimethylpropyl, 1,2,2-trimethylpropyl, 1-ethyl-1-methylpropyl and 1-ethyl-2-methylpropyl; and also n-heptyl, n-octyl, n-nonyl and n-decyl, and the singly or multiply branched analogs thereof.

"Hydroxyalkyl" represents especially the mono- or polyhydroxylated, especially monohydroxylated, analogs of the above alkyl radicals, for example the monohydroxylated analogs of the above straight-chain or branched alkyl radicals, for example the linear hydroxyalkyl groups with a primary hydroxyl group, such as hydroxymethyl, 2-hydroxyethyl, 3-hydroxypropyl, 4-hydroxybutyl.

"Alkenyl" represents mono- or polyunsaturated, especially monounsaturated, straight-chain or branched hydrocarbon radicals having 2 to 4, 2 to 6, 2 to 8, 2 to 10 or 2 or to 20 carbon atoms and a double bond in any position, for example $C_2$-$C_6$-alkenyl such as ethenyl, 1-propenyl, 2-propenyl, 1-methylethenyl, 1-butenyl, 2-butenyl, 3-butenyl, 1-methyl-1-propenyl, 2-methyl-1-propenyl, 1-methyl-2-propenyl, 2-methyl-2-propenyl, 1-pentenyl, 2-pentenyl, 3-pentenyl, 4-pentenyl, 1-methyl-1-butenyl, 2-methyl-1-butenyl, 3-methyl-1-butenyl, 1-methyl-2-butenyl, 2-methyl-2-butenyl, 3-methyl-2-butenyl, 1-methyl-3-butenyl, 2-methyl-3-butenyl, 3-methyl-3-butenyl, 1,1-dimethyl-2-propenyl, 1,2-dimethyl-1-propenyl, 1,2-dimethyl-2-propenyl, 1-ethyl-1-propenyl, 1-ethyl-2-propenyl, 1-hexenyl, 2-hexenyl, 3-hexenyl, 4-hexenyl, 5-hexenyl, 1-methyl-1-pentenyl, 2-methyl-1-pentenyl, 3-methyl-1-pentenyl, 4-methyl-1-pentenyl, 1-methyl-2-pentenyl, 2-methyl-2-pentenyl, 3-methyl-2-pentenyl, 4-methyl-2-pentenyl, 1-methyl-3-pentenyl, 2-methyl-3-pentenyl, 3-methyl-3-pentenyl, 4-methyl-3-pentenyl, 1-methyl-4-pentenyl, 2-methyl-4-pentenyl, 3-methyl-4-pentenyl, 4-methyl-4-pentenyl, 1,1-dimethyl-2-butenyl, 1,1-dimethyl-3-butenyl, 1,2-dimethyl-1-butenyl, 1,2-dimethyl-2-butenyl, 1,2-dimethyl-3-butenyl, 1,3-dimethyl-1-butenyl, 1,3-dimethyl-2-butenyl, 1,3-dimethyl-3-butenyl, 2,2-dimethyl-3-butenyl, 2,3-dimethyl-1-butenyl, 2,3-dimethyl-2-butenyl, 2,3-dimethyl-3-butenyl, 3,3-dimethyl-1-butenyl, 3,3-dimethyl-2-butenyl, 1-ethyl-1-butenyl, 1-ethyl-2-butenyl, 1-ethyl-3-butenyl, 2-ethyl-1-butenyl, 2-ethyl-2-butenyl, 2-ethyl-3-butenyl, 1,1,2-trimethyl-2-propenyl, 1-ethyl-1-methyl-2-propenyl, 1-ethyl-2-methyl-1-propenyl and 1-ethyl-2-methyl-2-propenyl.

"Alkylene" represents straight-chain or mono- or polybranched hydrocarbon bridge groups having 1 to 10 carbon atoms, for example $C_1$-$C_7$-alkylene groups selected from —$CH_2$—, —$(CH_2)_2$—, —$(CH_2)_3$—, —$CH_2$—$CH(CH_3)$—, —$CH(CH_3)$—$CH_2$—, $(CH_2)_4$—, —$(CH_2)_2$—$CH(CH_3)$—, —$CH_2$—$CH(CH_3)$—$CH_2$—, $(CH_2)_4$—, —$(CH_2)_5$—, —$(CH_2)_6$, —$(CH_2)_7$—, —$CH(CH_3)$—$CH_2$—$CH_2$—$CH(CH_3)$— or —$CH(CH_3)$—$CH_2$—$CH_2$—$CH_2$—$CH(CH_3)$— or $C_1$-$C_4$-alkylene groups selected from —$CH_2$—, —$(CH_2)_2$—, —$(CH_2)_3$—, —$CH_2$—$CH(CH_3)$—, —$CH(CH_3)$—$CH_2$—, —$(CH_2)_4$—, —$(CH_2)_2$—$CH(CH_3)$—, —$CH_2$—$CH(CH_3)$—$CH_2$—.

"Alkenylene" represents the mono- or polyunsaturated, especially monounsaturated, analogs of the above alkylene groups having 2 to 10 carbon atoms, especially $C_2$-$C_7$-alkenylenes or $C_2$-$C_4$-alkenylenes, such as —CH=CH—, —CH=CH—$CH_2$—, —$CH_2$—CH=CH—, —CH=CH—$CH_2$—$CH_2$—, —$CH_2$—CH=CH—$CH_2$—, —$CH_2$—$CH_2$—CH=CH—, —$CH(CH_3)$—CH=CH—, —$CH_2$—$C(CH_3)$=CH—.

"Cyclic hydrocarbyl radicals" comprise especially:

cycloalkyl: carbocyclic radicals having 3 to 20 carbon atoms, for example $C_3$-$C_{12}$-cycloalkyl such as cyclopropyl, cyclobutyl, cyclopentyl, cyclohexyl, cycloheptyl, cyclooctyl, cyclononyl, cyclodecyl, cycloundecyl and cyclododecyl; preference is given to cyclopentyl, cyclohexyl, cycloheptyl, and also to cyclopropylmethyl, cyclopropylethyl, cyclobutylmethyl, cyclobutylethyl, cyclopentylmethyl, cyclopentylethyl, cyclohexylmethyl, or $C_3$-$C_7$-cycloalkyl such as cyclopropyl, cyclobutyl, cyclopentyl, cyclohexyl, cycloheptyl, cyclopropylmethyl, cyclopropylethyl, cyclobutylmethyl, cyclopentylethyl, cyclohexylmethyl, where the bond to the rest of the molecule may be via any suitable carbon atom.

cycloalkenyl: monocyclic, monounsaturated hydrocarbon groups having 5 to 8, preferably up to 6, carbon ring members, such as cyclopenten-1-yl, cyclopenten-3-yl, cyclohexen-1-yl, cyclohexen-3-yl and cyclohexen-4-yl;

aryl: mono- or polycyclic, preferably mono- or bicyclic, optionally substituted aromatic radicals having 6 to 20, for example 6 to 10, ring carbon atoms, for example phenyl, biphenyl, naphthyl such as 1- or 2-naphthyl, tetrahydronaphthyl, fluorenyl, indenyl and phenanthrenyl. These aryl radicals may optionally bear 1, 2, 3, 4, 5 or 6 identical or different substituents.

"Substituents" for radicals specified herein are especially, unless stated otherwise, selected from keto groups, —COOH, —COO-alkyl, —OH, —SH, —CN, amino, —$NO_2$, alkyl, or alkenyl groups.

The term "about" in the context of a stated figure or of a value range denotes deviations from the specifically disclosed values. These are usually customary deviations. These may differ, for example, by ±10% to ±0.1% from the specific values. Typically, such deviations are about ±8% to ±1% or ±5%, ±4%, ±3% or ±2%.

A3) Polycarboxylic Acid Compounds and Hydrocarbyl-Substituted Polycarboxylic Acid Compounds The polycarboxylic acid compounds used are aliphatic di- or polybasic (for example tri- or tetrabasic), especially from di-, tri- or tetracarboxylic acids and analogs thereof, such as anhydrides or lower alkyl esters (partially or completely esterified), and is optionally substituted by one or more (for example 2 or 3), especially a long-chain alkyl radical and/or a high molecular weight hydrocarbyl radical, especially a polyalkylene radical. Examples are $C_3$-$C_{10}$ polycarboxylic acids, such as the dicarboxylic acids malonic acid, succinic acid, glutaric acid, adipic acid, pimelic acid, suberic acid, azelaic acid and sebacic acid, and the branched analogs thereof; and the tricarboxylic acid citric acid; and anhydrides or lower alkyl esters thereof of. The polycarboxylic acid compounds can also be obtained from the corresponding monounsaturated acids and addition of at least one long-chain alkyl radical and/or high molecular weight hydrocarbyl radical. Examples of suitable monounsaturated acids are fumaric acid, maleic acid, itaconic acid.

The hydrophobic "long-chain" or "high molecular weight" hydrocarbyl radical which ensures sufficient solubility of the quaternized product in the fuel has a number-average molecular weight ($M_n$) of 85 to 20 000, for example 113 to 10 000, or 200 to 10 000 or 350 to 5000, for example 350 to 3000, 500 to 2500, 700 to 2500, or 800 to 1500. Typical hydrophobic hydrocarbyl radicals include polypropenyl, polybutenyl and polyisobutenyl radicals, for example with a number-average molecular weight $M_n$ of 3500 to 5000, 350 to 3000, 500 to 2500, 700 to 2500 and 800 to 1500.

Suitable hydrocarbyl-substituted compounds are described, for example, in DE 43 19 672 and WO 2008/138836.

Suitable hydrocarbyl-substituted polycarboxylic acid compounds also comprise polymeric, especially dimeric, forms of such hydrocarbyl-substituted polycarboxylic acid compounds. Dimeric forms comprise, for example, two acid anhydride groups which can be reacted independently with the quaternizable nitrogen compound in the preparation process according to the invention.

A4) Quaternizing Agents

Useful quaternizing agents are in principle all alkyl esters which are suitable as such and are those of a cycloaromatic or cycloaliphatic mono- or polycarboxylic acid (especially of a mono- or dicarboxylic acid) or of an aliphatic polycarboxylic acid (especially dicarboxylic acid).

In a particular embodiment, however, the at least one quaternizable tertiary nitrogen atom is quaternized with at least one quaternizing agent selected from a) compounds of the general formula 1

$$R_1OC(O)R^2 \quad (1)$$

in which $R_1$ is a lower alkyl radical and $R_2$ is an optionally substituted monocyclic aryl or cycloalkyl radical, where the substituent is selected from OH, $NH_2$, $NO_2$, $C(O)OR_3$, and $R_{1a}OC(O)$—, in which $R_{1a}$ is as defined above for $R_1$ and $R_3$ is H or $R_1$;

and b) compounds of the general formula 2

$$R_1OC(O)\text{-}A\text{-}C(O)OR_{1a} \quad (2)$$

in which $R_1$ and $R_{1a}$ are each independently a lower alkyl radical and

A is hydrocarbylene (such as alkylene or alkenylene).

Particularly suitable compounds of the formula 1 are those in which $R_1$ is a $C_1$-, $C_2$- or $C_3$-alkyl radical and $R_2$ is a substituted phenyl radical, where the substituent is HO— or an ester radical of the formula $R_{1a}OC(O)$— which is in the para, meta or especially ortho position to the $R_1OC(O)$— radical on the aromatic ring.

Especially suitable quaternizing agents are the lower alkyl esters of salicylic acid, such as methyl salicylate, ethyl salicylate, n- and i-propyl salicylate, and n-, i- or tert-butyl salicylate.

A5) Quaternized or Quaternizable Nitrogen Compounds

The quaternizable nitrogen compounds reactive with the polycarboxylic acid compound are selected from a. hydroxyalkyl-substituted mono- or polyamines having at least one quaternized (e.g. choline) or quaternizable primary, secondary or tertiary amino group;
b. straight-chain or branched, cyclic, heterocyclic, aromatic or nonaromatic polyamines having at least one primary or secondary (anhydride-reactive) amino group and having at least one quaternized or quaternizable primary, secondary or tertiary amino group;
c. piperazines.

The quaternizable nitrogen compound is especially selected from d. hydroxyalkyl-substituted primary, secondary, tertiary or quaternary monoamines and hydroxyalkyl-substituted primary, secondary, tertiary or quaternary diamines;
e. straight-chain or branched aliphatic diamines having two primary amino groups; di- or polyamines having at least one primary and at least one secondary amino group; di- or polyamines having at least one primary and at least one tertiary amino group; di- or polyamines having at least one primary and at least one quaternary amino group; aromatic carbocyclic diamines having two primary amino groups; aromatic heterocyclic polyamines having two primary amino groups; aromatic or nonaromatic heterocycles having one primary and one tertiary amino group.

Examples of suitable "hydroxyalkyl-substituted mono- or polyamines" are those provided with at least one hydroxyalkyl substituted, for example 1, 2, 3, 4, 5 or 6 hydroxyalkyl substituted.

Examples of "hydroxyalkyl-substituted monoamines" include: N-hydroxyalkyl monoamines, N,N-dihydroxyalkyl monoamines and N,N,N-trihydroxyalkyl monoamines, where the hydroxyalkyl groups are the same or different and are also as defined above. Hydroxyalkyl is especially 2-hydroxyethyl, 3-hydroxypropyl or 4-hydroxybutyl.

For example, the following "hydroxyalkyl-substituted polyamines" and especially "hydroxyalkyl-substituted diamines" may be mentioned: (N-hydroxyalkyl)alkylenediamines, N,N-dihydroxyalkylalkylenediamines, where the hydroxyalkyl groups are the same or different and are also as defined above. Hydroxyalkyl is especially 2-hydroxyethyl, 3-hydroxypropyl or 4-hydroxybutyl; alkylene is especially ethylene, propylene or butylene.

Suitable "diamines" are alkylenediamines, and the N-alkyl-substituted analogs thereof, such as N-monoalkylated alkylenediamines and the N,N- or N,N'-dialkylated alkylenediamines. Alkylene is especially straight-chain or branched $C_{1-7}$- or $C_{1-4}$-alkylene as defined above. Alkyl is especially $C_{1-4}$-alkyl as defined above. Examples are especially ethylenediamine, 1,2-propylenediamine, 1,3-propylenediamine, 1,4-butylenediamine and isomers thereof, pentanediamine and isomers thereof, hexanediamine and isomers thereof, heptanediamine and isomers thereof, and singly or multiply, for example singly or doubly, $C_1$-$C_4$-alkylated, for example methylated, derivatives of the aforementioned diamine compounds such as 3-dimethylamino-1-propylamine (DMAPA), N,N-diethylaminopropylamine and N, N-dimethylamino-ethylamine.

Suitable straight-chain "polyamines" are, for example, dialkylenetriamine, trialkylenetetramine, tetraalkylenepentamine, pentaalkylenehexamine, and the N-alkyl-substituted analogs thereof, such as N-monoalkylated and the N,N- or N,N'-dialkylated alkylenepolyamines. Alkylene is especially straight-chain or branched or $C_{1-4}$-alkylene as defined above. Alkyl is especially $C_{1-4}$-alkyl as defined above.

Examples are especially diethylenetriamine, triethylenetetramine, tetraethylenepentamine, pentaethylenehexamine, dipropylenetriamine, tripropylenetetramine, tetrapropylenepentamine, pentapropylenehexamine, dibutylenetriamine, tributylenetetramine, tetrabutylenepentamine, pentabutylenehexamine; and the N,N-dialkyl derivatives thereof, especially the N,N-di-$C_{1-4}$-alkyl derivatives thereof. Examples include: N,N-dimethyldimethylenetriamine, N,N-diethyldimethylenetriamine, N,N-dipropyldimethylenetriamine, N,N-dimethyldiethylene-1,2-triamine, N,N-diethyldiethylene-1,2-triamine, N,N-dipropyldiethylene-1,2-triamine, N,N-dimethyldipropylene-1,3-triamine (i.e. DMAPAPA), N,N-diethyldipropylene-1,3-triamine, N,N-dipropyldipropylene-1,3-triamine, N,N-dimethyldibutylene-1,4-triamine, N,N-diethyldibutylene-1,4-triamine, N,N-dipropyldibutylene-1,4-triamine, N,N-dimethyldipentylene-1,5-triamine, N,N-diethyldipentylene-1,5-triamine, N,N-dipropyldipentylene-1,5-triamine, N,N-dimethyldihexylene-1,6-triamine, N,N-diethyldihexylene-1,6-triamine and N,N-dipropyldihexylene-1,6-triamine.

"Aromatic carbocyclic diamines" having two primary amino groups are the diamino-substituted derivatives of benzene, biphenyl, naphthalene, tetrahydronaphthalene, fluorene, indene and phenanthrene.

"Aromatic or nonaromatic heterocyclic polyamines" having two primary amino groups are the derivatives, substituted by two amino groups, of the following heterocycles:

5- or 6-membered, saturated or monounsaturated heterocycles comprising one to two nitrogen atoms and/or one oxygen or sulfur atom or one or two oxygen and/or sulfur atoms as ring members, for example tetrahydrofuran, pyrrolidine, isoxazolidine, isothiazolidine, pyrazolidine, oxazolidine, thiazolidine, imidazolidine, pyrroline, piperidine, piperidinyl, 1,3-dioxane, tetrahydropyran, hexahydropyridazine, hexahydropyrimidine, piperazine;

5-membered aromatic heterocycles comprising, in addition to carbon atoms, two or three nitrogen atoms or one or two nitrogen atoms and one sulfur or oxygen atom as ring members, for example furan, thiane, pyrrole, pyrazole, oxazole, thiazole, imidazole and 1,3,4-triazole; isoxazole, isothiazole, thiadiazole, oxadiazole;

6-membered heterocycles comprising, in addition to carbon atoms, one or two, or one, two or three, nitrogen atoms as ring members, for example pyridinyl, pyridazine, pyrimidine, pyrazinyl, 1,2,4-triazine, 1,3,5-triazin-2-yl.

"Aromatic or nonaromatic heterocycles having one primary and one tertiary amino group" are, for example, the abovementioned N-heterocycles which are aminoalkylated on at least one ring nitrogen atom, and especially bear an amino-$C_{1-4}$-alkyl group.

"Aromatic or nonaromatic heterocycles having a tertiary amino group and a hydroxyalkyl group" are, for example, the abovementioned N-heterocycles which are hydroxyalkylated on at least one ring nitrogen atom, and especially bear a hydroxy-$C_{1-4}$-alkyl group.

Mention should be made especially of the following groups of individual classes of quaternizable nitrogen compounds:

Group 1:

| NAME | FORMULA |
|---|---|
| Diamines with primary second nitrogen atom | |
| Ethylenediamine | 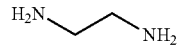 |
| 1,2-Propylenediamine | 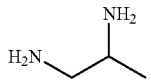 |
| 1,3-Propylenediamine | 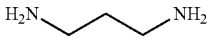 |
| Isomeric butylenediamines, for example | 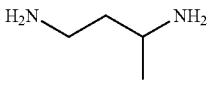 |
| 1,5-Pentylenediamine | 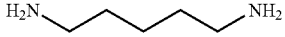 |
| Isomeric pentanediamines, for example | 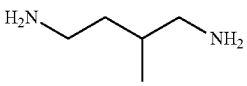 |
| Isomeric hexanediamines, for example | 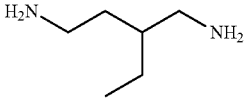 |

-continued

| NAME | FORMULA |
|---|---|
| Isomeric heptanediamines, for example | 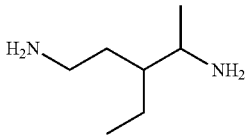 |
| Di- and polyamines with a secondary second nitrogen atom | |
| Diethylenetriamine (DETA) | 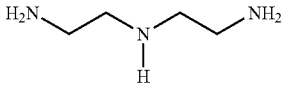 |
| Dipropylenetriamine (DPTA), 3,3'-iminobis(N,N-dimethylpropylamine) | 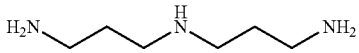 |
| Triethylenetetramine (TETA) | 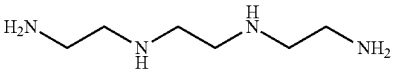 |
| Tetraethylenepentamine (TEPA) | 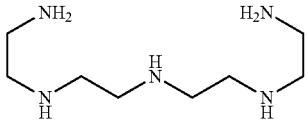 |
| Pentaethylenehexamine | 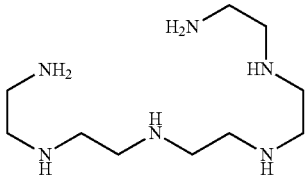 |
| N-Methyl-3-amino-1-propylamine | 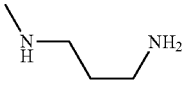 |
| Bishexamethylenetriamine | 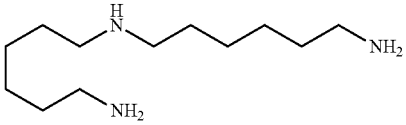 |
| Aromatics | |
| Diaminobenzenes, for example | 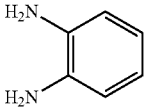 |
| Diaminopyridines, for example | 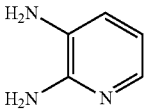 |

Group 2:

| NAME | FORMULA |
|---|---|
| Heterocycles | |
| 1-(3-Aminopropyl)imidazole | 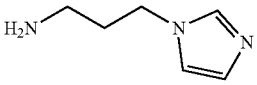 |

-continued

| NAME | FORMULA |
|---|---|
| 4-(3-Aminopropyl)morpholine | 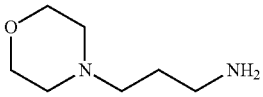 |

-continued

| NAME | FORMULA |
|---|---|
| 1-(2-Aminoethylpiperidine) | 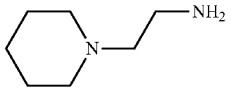 |
| 2-(1-Piperazinyl)ethylamine (AEP) | 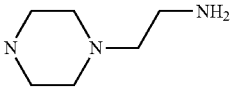 |
| N-Methylpiperazine | 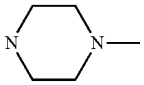 |
| Amines with a tertiary second nitrogen atom | |
| 3,3-Diamino-N-methyldipropylamine | 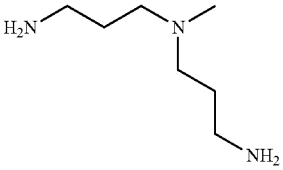 |
| 3-Dimethylamino-1-propylamine (DMAPA) | 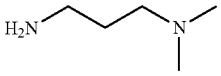 |
| N,N-Diethylaminopropylamine | 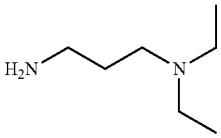 |
| N,N-Dimethylaminoethylamine | 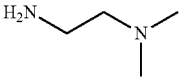 |

Group 3:

| NAME | FORMULA |
|---|---|
| Alcohols with a primary and secondary amine | |
| Ethanolamine | 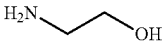 |
| 3-Hydroxy-1-propylamine | 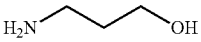 |
| Diethanolamine | 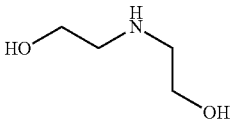 |
| Diisopropanolamine | 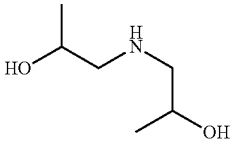 |
| N-(2-Hydroxyethyl) ethylenediamine | 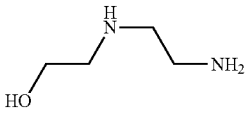 |

-continued

| NAME | FORMULA |
|---|---|
| Alcohols with a tertiary amine | |
| Triethanolamine, (2,2$^{I}$,2$^{II}$-Nitrilotriethanol) | 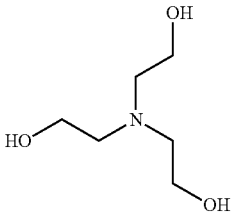 |
| 1-(3-Hydroxypropyl)imidazole | 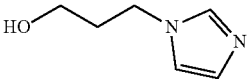 |
| Tris(hydroxymethyl)amine | 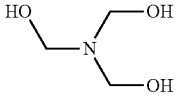 |
| 3-Dimethylamino-1-propanol | 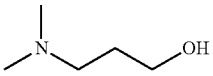 |
| 3-Diethylamino-1-propanol | 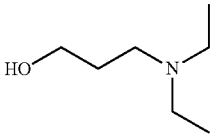 |
| 2-Dimethylamino-1-ethanol | 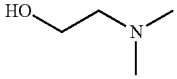 |
| 4-Diethylamino-1-butanol | 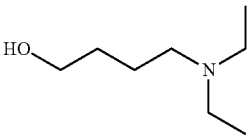 |

A6) Preparation of Inventive Additives a) Reaction with Oxygen or Nitrogen Group The hydrocarbyl-substituted polycarboxylic acid compound can be reacted with the quaternizable nitrogen compound according to the present invention under thermally controlled conditions, such that there is essentially no condensation reaction. More particularly, no formation of water of reaction is observed in that case. More particularly, such a reaction is effected at a temperature in the range from 10 to 80° C., especially 20 to 60° C. or 30 to 50° C. The reaction time may be in the range from a few minutes or a few hours, for example about 1 minute up to about 10 hours. The reaction can be effected at a pressure of about 0.1 to 2 atm, but especially at approximately standard pressure. For example, an inert gas atmosphere, for example nitrogen, is appropriate.

More particularly, the reaction can also be effected at elevated temperatures which promote condensation, for example in the range from 90 to 100° C. or 100 to 170° C. The reaction time may be in the region of a few minutes or a few hours, for example about 1 minute up to about 10 hours. The reaction can be effected at pressure at about 0.1 to 2 atm, but especially at about standard pressure.

The reactants are initially charged especially in about equimolar amounts; optionally, a small molar excess of the polycarboxylic acid compound, for example a 0.05- to 0.5-fold, for example a 0.1- to 0.3-fold, excess, is desirable. If required, the reactants can be initially charged in a suitable inert organic aliphatic or aromatic solvent or a mixture thereof. Typical examples are, for example, solvents of the Solvesso series, toluene or xylene. The solvent can also serve, for example, to remove water of condensation azeotropically from the reaction mixture. More particularly, however, the reactions are performed without solvent.

The reaction product thus formed can theoretically be purified further, or the solvent can be removed. Usually, however, this is not absolutely necessary, such that the reaction step can be transferred without further purification into the next synthesis step, the quaternization.

b) Quaternization

The quaternization in reaction step (b) is then carried out in a manner known per se.

To perform the quaternization, the reaction product or reaction mixture from stage a) is admixed with at least one compound of the above formula 1 or 2, especially in the stoichiometric amounts required to achieve the desired quaternization. It is possible to use, for example, 0.1 to 2.0, 0.2 to 1.5 or 0.5 to 1.25 equivalents, of quaternizing agent per equivalent of quaternizable tertiary nitrogen atom. More particularly, however, approximately equimolar proportions of the compound are used to quaternize a tertiary amine group. Correspondingly higher use amounts are required to quaternize a secondary or primary amine group. In a further variant, the quaternizing agent is added in excess, for example 1.1 to 2.0, 1.25 to 2 or 1.25 to 1.75 equivalents of quaternizing agent per equivalent of quaternizable tertiary nitrogen atom.

Typical working temperatures here are in the range from 50 to 180° C., for example from 90 to 160° C. or 100 to 140° C. The reaction time may be in the range of a few minutes or a few hours, for example about 10 minutes up to about 24 hours. The reaction can be effected at a pressure of about 0.1 to 20 bar, for example 1 to 10 or 1.5 to 3 bar, but especially at about standard pressure.

If required, the reactants can be initially charged for the quaternization in a suitable inert organic aliphatic or aromatic solvent or a mixture thereof, or a sufficient proportion of solvent from reaction step a) is still present. Typical examples are, for example, solvents of the Solvesso series, toluene or xylene. The quaternization can, however, also be performed in the absence of a solvent.

To perform the quaternization, the addition of catalytically active amounts of an acid may be appropriate. Preference is given to aliphatic monocarboxylic acids, for example $C_1$-$C_{18}$-monocarboxylic acids such as especially lauric acid, isononanoic acid or neodecanoic acid. The quaternization can also be performed in the presence of a Lewis acid. The quaternization can, however, also be performed in the absence of any acid.

c) Workup of the Reaction Mixture

The reaction end product thus formed can theoretically be purified further, or the solvent can be removed. In order to improve the further processability of the products, however, it is also possible to add solvent after the reaction, for example solvents from the Solvesso series, 2-ethylhexanol, or essentially aliphatic solvents. Usually, however, this is not absolutely necessary, and so the reaction product is usable without further purification as an additive, optionally after blending with further additive components (see below).

B) Further Additive Components

The fuel additized with the inventive quaternized additive is a gasoline fuel or especially a middle distillate fuel, in particular a diesel fuel.

The fuel may comprise further customary additives to improve efficacy and/or suppress wear.

In the case of diesel fuels, these are primarily customary detergent additives, carrier oils, cold flow improvers, lubricity improvers, corrosion inhibitors, demulsifiers, dehazers, antifoams, cetane number improvers, combustion improvers, antioxidants or stabilizers, antistats, metallocenes, metal deactivators, dyes and/or solvents.

In the case of gasoline fuels, these are in particular lubricity improvers (friction modifiers), corrosion inhibitors, demulsifiers, dehazers, antifoams, combustion improvers, antioxidants or stabilizers, antistats, metallocenes, metal deactivators, dyes and/or solvents.

Typical examples of suitable coadditives are listed in the following section:

B1) Detergent Additives

The customary detergent additives are preferably amphiphilic substances which possess at least one hydrophobic hydrocarbon radical with a number-average molecular weight ($M_n$) of 85 to 20 000 and at least one polar moiety selected from:

(Da) mono- or polyamino groups having up to 6 nitrogen atoms, at least one nitrogen atom having basic properties;

(Db) nitro groups, optionally in combination with hydroxyl groups;

(Dc) hydroxyl groups in combination with mono- or polyamino groups, at least one nitrogen atom having basic properties;

(Dd) carboxyl groups or their alkali metal or alkaline earth metal salts;

(De) sulfonic acid groups or their alkali metal or alkaline earth metal salts;

(Df) polyoxy-$C_2$- to $C_4$-alkylene moieties terminated by hydroxyl groups, mono- or polyamino groups, at least one nitrogen atom having basic properties, or by carbamate groups;

(Dg) carboxylic ester groups;

(Dh) moieties derived from succinic anhydride and having hydroxyl and/or amino and/or amido and/or imido groups; and/or (Di) moieties obtained by Mannich reaction of substituted phenols with aldehydes and mono- or polyamines.

The hydrophobic hydrocarbon radical in the above detergent additives, which ensures the adequate solubility in the fuel, has a number-average molecular weight ($M_n$) of 85 to 20 000, preferably of 113 to 10 000, more preferably of 300 to 5000, even more preferably of 300 to 3000, even more especially preferably of 500 to 2500 and especially of 700 to 2500, in particular of 800 to 1500. As typical hydrophobic hydrocarbon radicals, especially in conjunction with the polar especially polypropenyl, polybutenyl and polyisobutenyl radicals with a number-average molecular weight $M_n$ of preferably in each case 300 to 5000, more preferably 300 to 3000, even more preferably 500 to 2500, even more especially preferably 700 to 2500 and especially 800 to 1500 into consideration.

Examples of the above groups of detergent additives include the following:

Additives comprising mono- or polyamino groups (Da) are preferably polyalkenemono- or polyalkenepolyamines based on polypropene or on high-reactivity (i.e. having predominantly terminal double bonds) or conventional (i.e.

having predominantly internal double bonds) polybutene or polyisobutene having $M_n$=300 to 5000, more preferably 500 to 2500 and especially 700 to 2500. Such additives based on high-reactivity polyisobutene, which can be prepared from the polyisobutene which may comprise up to 20% by weight of n-butene units by hydroformylation and reductive amination with ammonia, monoamines or polyamines such as dimethylaminopropylamine, ethylenediamine, diethylenetriamine, triethylenetetramine or tetraethylenepentamine, are known especially from EP-A 244 616. When polybutene or polyisobutene having predominantly internal double bonds (usually in the β and γ positions) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. The amines used here for the amination may be, for example, ammonia, monoamines or the abovementioned polyamines. Corresponding additives based on polypropene are described in particular in WO-A 94/24231.

Further particular additives comprising monoamino groups (Da) are the hydrogenation products of the reaction products of polyisobutenes having an average degree of polymerization P=5 to 100 with nitrogen oxides or mixtures of nitrogen oxides and oxygen, as described in particular in WO-A 97/03946.

Further particular additives comprising monoamino groups (Da) are the compounds obtainable from polyisobutene epoxides by reaction with amines and subsequent dehydration and reduction of the amino alcohols, as described in particular in DE-A 196 20 262.

Additives comprising nitro groups (Db), optionally in combination with hydroxyl groups, are preferably reaction products of polyisobutenes having an average degree of polymerization P=5 to 100 or 10 to 100 with nitrogen oxides or mixtures of nitrogen oxides and oxygen, as described in particular in WO-A 96/03367 and in WO-A 96/03479. These reaction products are generally mixtures of pure nitropolyisobutenes (e.g. α,β-dinitropolyisobutene) and mixed hydroxynitropolyisobutenes (e.g. α-nitro-β-hydroxypolyisobutene).

Additives comprising hydroxyl groups in combination with mono- or polyamino groups (Dc) are in particular reaction products of polyisobutene epoxides obtainable from polyisobutene having preferably predominantly terminal double bonds and $M_n$=300 to 5000, with ammonia or mono- or polyamines, as described in particular in EP-A 476 485.

Additives comprising carboxyl groups or their alkali metal or alkaline earth metal salts (Dd) are preferably copolymers of $C_2$- to $C_{40}$-olefins with maleic anhydride which have a total molar mass of 500 to 20 000 and some or all of whose carboxyl groups have been converted to the alkali metal or alkaline earth metal salts and any remainder of the carboxyl groups has been reacted with alcohols or amines. Such additives are disclosed in particular by EP-A 307 815. Such additives serve mainly to prevent valve seat wear and can, as described in WO-A 87/01126, advantageously be used in combination with customary fuel detergents such as poly(iso)buteneamines or polyetheramines.

Additives comprising sulfonic acid groups or their alkali metal or alkaline earth metal salts (De) are preferably alkali metal or alkaline earth metal salts of an alkyl sulfosuccinate, as described in particular in EP-A 639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (Df) are preferably polyethers or polyetheramines which are obtainable by reaction of $C_2$- to $C_{60}$-alkanols, $C_6$- to $C_{30}$-alkanediols, mono- or di-$C_2$- to $C_{30}$-alkylamines, $C_1$- to $C_{30}$-alkylcyclohexanols or $C_1$- to $C_{30}$-alkylphenols with 1 to 30 mol of ethylene oxide and/or propylene oxide and/or butylene oxide per hydroxyl group or amino group and, in the case of the polyetheramines, by subsequent reductive amination with ammonia, monoamines or polyamines. Such products are described in particular in EP-A 310 875, EP-A 356 725, EP-A 700 985 and U.S. Pat. No. 4,877,416. In the case of polyethers, such products also have carrier oil properties. Typical examples of these are tridecanol butoxylates, isotridecanol butoxylates, isononylphenol butoxylates and polyisobutenol butoxylates and propoxylates and also the corresponding reaction products with ammonia.

Additives comprising carboxylic ester groups (Dg) are preferably esters of mono-, di- or tricarboxylic acids with long-chain alkanols or polyols, in particular those having a minimum viscosity of 2 $mm^2/s$ at 100° C., as described in particular in DE-A 38 38 918. The mono-, di- or tricarboxylic acids used may be aliphatic or aromatic acids, and particularly suitable ester alcohols or ester polyols are long-chain representatives having, for example, 6 to 24 carbon atoms. Typical representatives of the esters are adipates, phthalates, isophthalates, terephthalates and trimellitates of isooctanol, of isononanol, of isodecanol and of isotridecanol. Such products also have carrier oil properties.

Additives comprising moieties derived from succinic anhydride and having hydroxyl and/or amino and/or amido and/or especially imido groups (Dh) are preferably corresponding derivatives of alkyl- or alkenyl-substituted succinic anhydride and especially the corresponding derivatives of polyisobutenylsuccinic anhydride which are obtainable by reacting conventional or high-reactivity polyisobutene having $M_n$=preferably 300 to 5000, more preferably 300 to 3000, even more preferably 500 to 2500, even more especially preferably 700 to 2500 and especially 800 to 1500, with maleic anhydride by a thermal route in an ene reaction or via the chlorinated polyisobutene. The moieties having hydroxyl and/or amino and/or amido and/or imido groups are, for example, carboxylic acid groups, acid amides of monoamines, acid amides of di- or polyamines which, in addition to the amide function, also have free amine groups, succinic acid derivatives having an acid and an amide function, carboximides with monoamines, carboximides with di- or polyamines which, in addition to the imide function, also have free amine groups, or diimides which are formed by the reaction of di- or polyamines with two succinic acid derivatives. In the presence of imido moieties D(h), the further detergent additive in the context of the present invention is, however, used only up to a maximum of 100% of the weight of compounds with betaine structure. Such fuel additives are common knowledge and are described, for example, in documents (1) and (2). They are preferably the reaction products of alkyl- or alkenyl-substituted succinic acids or derivatives thereof with amines and more preferably the reaction products of polyisobutenyl-substituted succinic acids or derivatives thereof with amines. Of particular interest in this context are reaction products with aliphatic polyamines (polyalkyleneimines) such as especially ethylenediamine, diethylenetriamine, triethylenetetramine, tetraethylenepentamine, pentaethylenehexamine and hexaethyleneheptamine, which have an imide structure.

Additives comprising moieties (Di) obtained by Mannich reaction of substituted phenols with aldehydes and mono- or polyamines are preferably reaction products of polyisobutene-substituted phenols with formaldehyde and mono- or polyamines such as ethylenediamine, diethylenetriamine, triethylenetetramine, tetraethylenepentamine or dimethylaminopropylamine. The polyisobutenyl-substituted phenols may stem from conventional or high-reactivity polyisobutene having $M_n$=300 to 5000. Such "polyisobutene Mannich bases" are described in particular in EP-A 831 141.

One or more of the detergent additives mentioned can be added to the fuel in such an amount that the dosage of these detergent additives is preferably 25 to 2500 ppm by weight, especially 75 to 1500 ppm by weight, in particular 150 to 1000 ppm by weight.

B2) Carrier Oils

Carrier oils additionally used may be of mineral or synthetic nature. Suitable mineral carrier oils are the fractions obtained in crude oil processing, such as brightstock or base oils having viscosities, for example, from the SN 500 to 2000 class; but also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range from about 360 to 500° C., obtainable from natural mineral oil which has been catalytically hydrogenated and isomerized under high pressure and also deparaffinized). Likewise suitable are mixtures of the abovementioned mineral carrier oils.

Examples of suitable synthetic carrier oils are polyolefins (polyalphaolefins or polyinternalolefins), (poly)esters, (poly)alkoxylates, polyethers, aliphatic polyetheramines, alkylphenol-started polyethers, alkylphenol-started polyetheramines and carboxylic esters of long-chain alkanols.

Examples of suitable polyolefins are olefin polymers having $M_n$=400 to 1800, in particular based on polybutene or polyisobutene (hydrogenated or unhydrogenated).

Examples of suitable polyethers or polyetheramines are preferably compounds comprising polyoxy-$C_2$- to $C_4$-alkylene moieties which are obtainable by reacting $C_2$- to $C_{60}$-alkanols, $C_6$- to $C_{30}$-alkanediols, mono- or di-$C_2$- to $C_{30}$-alkylamines, $C_1$- to $C_{30}$-alkylcyclohexanols or $C_1$- to $C_{30}$-alkylphenols with 1 to 30 mol of ethylene oxide and/or propylene oxide and/or butylene oxide per hydroxyl group or amino group, and, in the case of the polyetheramines, by subsequent reductive amination with ammonia, monoamines or polyamines. Such products are described in particular in EP-A 310 875, EP-A 356 725, EP-A 700 985 and U.S. Pat. No. 4,877,416. For example, the polyetheramines used may be poly-$C_2$- to $C_6$-alkylene oxide amines or functional derivatives thereof. Typical examples thereof are tridecanol butoxylates or isotridecanol butoxylates, isononylphenol butoxylates and also polyisobutenol butoxylates and propoxylates, and also the corresponding reaction products with ammonia.

Examples of carboxylic esters of long-chain alkanols are in particular esters of mono-, di- or tricarboxylic acids with long-chain alkanols or polyols, as described in particular in DE-A 38 38 918. The mono-, di- or tricarboxylic acids used may be aliphatic or aromatic acids; suitable ester alcohols or polyols are in particular long-chain representatives having, for example, 6 to 24 carbon atoms. Typical representatives of the esters are adipates, phthalates, isophthalates, terephthalates and trimellitates of isooctanol, isononanol, isodecanol and isotridecanol, for example di(n- or isotridecyl) phthalate.

Further suitable carrier oil systems are described, for example, in DE-A 38 26 608, DE-A 41 42 241, DE-A 43 09 074, EP-A 452 328 and EP-A 548 617.

Examples of particularly suitable synthetic carrier oils are alcohol-started polyethers having about 5 to 35, preferably about 5 to 30, more preferably 10 to 30 and especially 15 to 30 $C_3$- to $C_6$-alkylene oxide units, for example selected from propylene oxide, n-butylene oxide and isobutylene oxide units, or mixtures thereof, per alcohol molecule. Nonlimiting examples of suitable starter alcohols are long-chain alkanols or phenols substituted by long-chain alkyl in which the long-chain alkyl radical is in particular a straight-chain or branched $C_6$- to $C_{18}$-alkyl radical. Particular examples include tridecanol and nonylphenol. Particularly preferred alcohol-started polyethers are the reaction products (polyetherification products) of monohydric aliphatic $C_6$- to $C_{18}$-alcohols with $C_3$- to $C_6$-alkylene oxides. Examples of monohydric aliphatic $C_6$-$C_{18}$-alcohols are hexanol, heptanol, octanol, 2-ethylhexanol, nonyl alcohol, decanol, 3-propylheptanol, undecanol, dodecanol, tridecanol, tetradecanol, pentadecanol, hexadecanol, octadecanol and the constitutional and positional isomers thereof. The alcohols can be used either in the form of the pure isomers or in the form of technical grade mixtures. A particularly preferred alcohol is tridecanol. Examples of $C_3$- to $C_6$-alkylene oxides are propylene oxide, such as 1,2-propylene oxide, butylene oxide, such as 1,2-butylene oxide, 2,3-butylene oxide, isobutylene oxide or tetrahydrofuran, pentylene oxide and hexylene oxide. Particular preference among these is given to $C_3$- to $C_4$-alkylene oxides, i.e. propylene oxide such as 1,2-propylene oxide and butylene oxide such as 1,2-butylene oxide, 2,3-butylene oxide and isobutylene oxide. Especially butylene oxide is used.

Further suitable synthetic carrier oils are alkoxylated alkylphenols, as described in DE-A 10 102 913.

Particular carrier oils are synthetic carrier oils, particular preference being given to the above-described alcohol-started polyethers.

The carrier oil or the mixture of different carrier oils is added to the fuel in an amount of preferably 1 to 1000 ppm by weight, more preferably of 10 to 500 ppm by weight and especially of 20 to 100 ppm by weight.

B3) Cold Flow Improvers

Suitable cold flow improvers are in principle all organic compounds which are capable of improving the flow performance of middle distillate fuels or diesel fuels under cold conditions. For the intended purpose, they must have sufficient oil solubility. In particular, useful cold flow improvers for this purpose are the cold flow improvers (middle distillate flow improvers, MDFIs) typically used in the case of middle distillates of fossil origin, i.e. in the case of customary mineral diesel fuels. However, it is also possible to use organic compounds which partly or predominantly have the properties of a wax antisettling additive (WASA) when used in customary diesel fuels. They can also act partly or predominantly as nucleators. It is, though, also possible to use mixtures of organic compounds effective as MDFIs and/or effective as WASAs and/or effective as nucleators.

The cold flow improver is typically selected from (K1) copolymers of a $C_2$- to $C_{40}$-olefin with at least one further ethylenically unsaturated monomer;

(K2) comb polymers;

(K3) polyoxyalkylenes;

(K4) polar nitrogen compounds;

(K5) sulfocarboxylic acids or sulfonic acids or derivatives thereof; and (K6) poly(meth)acrylic esters.

It is possible to use either mixtures of different representatives from one of the particular classes (K1) to (K6) or mixtures of representatives from different classes (K1) to (K6).

Suitable $C_2$- to $C_{40}$-olefin monomers for the copolymers of class (K1) are, for example, those having 2 to 20 and especially 2 to 10 carbon atoms, and 1 to 3 and preferably 1 or 2 carbon-carbon double bonds, especially having one carbon-carbon double bond. In the latter case, the carbon-carbon double bond may be arranged either terminally (α-olefins) or internally. However, preference is given to α-olefins, more preferably α-olefins having 2 to 6 carbon atoms, for example propene, 1-butene, 1-pentene, 1-hexene and in particular ethylene.

In the copolymers of class (K1), the at least one further ethylenically unsaturated monomer is preferably selected from alkenyl carboxylates, (meth)acrylic esters and further olefins.

When further olefins are also copolymerized, they are preferably higher in molecular weight than the abovementioned $C_2$- to $C_{40}$-olefin base monomer. When, for example, the olefin base monomer used is ethylene or propene, suitable further olefins are in particular $C_{10}$- to $C_{40}$-α-olefins. Further olefins are in most cases only additionally copolymerized when monomers with carboxylic ester functions are also used.

Suitable (meth)acrylic esters are, for example, esters of (meth)acrylic acid with $C_1$- to $C_{20}$-alkanols, especially $C_1$- to $C_{10}$-alkanols, in particular with methanol, ethanol, propanol, isopropanol, n-butanol, sec-butanol, isobutanol, tert-butanol, pentanol, hexanol, heptanol, octanol, 2-ethylhexanol, nonanol and decanol, and structural isomers thereof.

Suitable alkenyl carboxylates are, for example, $C_2$- to $C_{14}$-alkenyl esters, for example the vinyl and propenyl esters, of carboxylic acids having 2 to 21 carbon atoms, whose hydrocarbon radical may be linear or branched. Among these, preference is given to the vinyl esters. Among the carboxylic acids with a branched hydrocarbon radical, preference is given to those whose branch is in the α-position to the carboxyl group, the α-carbon atom more preferably being tertiary, i.e. the carboxylic acid being a so-called neocarboxylic acid. However, the hydrocarbon radical of the carboxylic acid is preferably linear.

Examples of suitable alkenyl carboxylates are vinyl acetate, vinyl propionate, vinyl butyrate, vinyl 2-ethylhexanoate, vinyl neopentanoate, vinyl hexanoate, vinyl neononanoate, vinyl neodecanoate and the corresponding propenyl esters, preference being given to the vinyl esters. A particularly preferred alkenyl carboxylate is vinyl acetate; typical copolymers of group (K1) resulting therefrom are ethylene-vinyl acetate copolymers ("EVAs"), which are some of the most frequently used. Ethylene-vinyl acetate copolymers usable particularly advantageously and their preparation are described in WO 99/29748.

Suitable copolymers of class (K1) are also those which comprise two or more different alkenyl carboxylates in copolymerized form, which differ in the alkenyl function and/or in the carboxylic acid group. Likewise suitable are copolymers which, as well as the alkenyl carboxylate(s), comprise at least one olefin and/or at least one (meth)acrylic ester in copolymerized form.

Terpolymers of a $C_2$- to $C_{40}$-α-olefin, a $C_1$- to $C_{20}$-alkyl ester of an ethylenically unsaturated monocarboxylic acid having 3 to 15 carbon atoms and a $C_2$- to $C_{14}$-alkenyl ester of a saturated monocarboxylic acid having 2 to 21 carbon atoms are also suitable as copolymers of class (K1). Terpolymers of this kind are described in WO 2005/054314. A typical terpolymer of this kind is formed from ethylene, 2-ethylhexyl acrylate and vinyl acetate.

The at least one or the further ethylenically unsaturated monomer(s) are copolymerized in the copolymers of class (K1) in an amount of preferably 1 to 50% by weight, especially 10 to 45% by weight and in particular 20 to 40% by weight, based on the overall copolymer. The main proportion in terms of weight of the monomer units in the copolymers of class (K1) therefore originates generally from the $C_2$ to $C_{40}$ base olefins. The copolymers of class (K1) preferably have a number-average molecular weight $M_n$ of 1000 to 20 000, more preferably 1000 to 10 000 and in particular 1000 to 8000.

Typical comb polymers of component (K2) are, for example, obtainable by the copolymerization of maleic anhydride or fumaric acid with another ethylenically unsaturated monomer, for example with an α-olefin or an unsaturated ester, such as vinyl acetate, and subsequent esterification of the anhydride or acid function with an alcohol having at least 10 carbon atoms. Further suitable comb polymers are copolymers of α-olefins and esterified comonomers, for example esterified copolymers of styrene and maleic anhydride or esterified copolymers of styrene and fumaric acid. Suitable comb polymers may also be polyfumarates or polymaleates. Homo- and copolymers of vinyl ethers are also suitable comb polymers. Comb polymers suitable as components of class (K2) are, for example, also those described in WO 2004/035715 and in "Comb-Like Polymers. Structure and Properties", N. A. Platé and V. P. Shibaev, J. Poly. Sci. Macromolecular Revs. 8, pages 117 to 253 (1974)". Mixtures of comb polymers are also suitable.

Polyoxyalkylenes suitable as components of class (K3) are, for example, polyoxyalkylene esters, polyoxyalkylene ethers, mixed polyoxyalkylene ester/ethers and mixtures thereof. These polyoxyalkylene compounds preferably comprise at least one linear alkyl group, preferably at least two linear alkyl groups, each having 10 to 30 carbon atoms and a polyoxyalkylene group having a number-average molecular weight of up to 5000. Such polyoxyalkylene compounds are described, for example, in EP-A 061 895 and also in U.S. Pat. No. 4,491,455. Particular polyoxyalkylene compounds are based on polyethylene glycols and polypropylene glycols having a number-average molecular weight of 100 to 5000. Additionally suitable are polyoxyalkylene mono- and diesters of fatty acids having 10 to 30 carbon atoms, such as stearic acid or behenic acid.

Polar nitrogen compounds suitable as components of class (K4) may be either ionic or nonionic and preferably have at least one substituent, in particular at least two substituents, in the form of a tertiary nitrogen atom of the general formula $>NR^7$ in which $R^1$ is a $C_8$- to $C_{40}$-hydrocarbon radical. The nitrogen substituents may also be quaternized, i.e. be in cationic form. An example of such nitrogen compounds is that of ammonium salts and/or amides which are obtainable by the reaction of at least one amine substituted by at least one hydrocarbon radical with a carboxylic acid having 1 to 4 carboxyl groups or with a suitable derivative thereof. The amines preferably comprise at least one linear $C_8$- to $C_{40}$-alkyl radical. Primary amines suitable for preparing the polar nitrogen compounds mentioned are, for example, octylamine, nonylamine, decylamine, undecylamine, dodecylamine, tetradecylamine and the higher linear homologs. Secondary amines suitable for this purpose are, for example, dioctadecylamine and methylbehenylamine. Also suitable for this purpose are amine mixtures, in particular amine mixtures obtainable on the industrial scale, such as fatty amines or hydrogenated tallamines, as described, for example, in Ullmann's Encyclopedia of Industrial Chemistry, 6th Edition, "Amines, aliphatic" chapter. Acids suitable for the reaction are, for example, cyclohexane-1,2-dicarboxylic acid, cyclohexene-1,2-dicarboxylic acid, cyclopentane-1,2-dicarboxylic acid, naphthalenedicarboxylic acid, phthalic acid, isophthalic acid, terephthalic acid, and succinic acids substituted by long-chain hydrocarbon radicals.

In particular, the component of class (K4) is an oil-soluble reaction product of poly($C_2$- to $C_{20}$-carboxylic acids) having at least one tertiary amino group with primary or secondary amines. The poly($C_2$- to $C_{20}$-carboxylic acids) which have at least one tertiary amino group and form the basis of this reaction product comprise preferably at least 3 carboxyl groups, especially 3 to 12 and in particular 3 to 5 carboxyl groups. The carboxylic acid units in the polycarboxylic acids have preferably 2 to 10 carbon atoms, and are especially acetic acid units. The carboxylic acid units are suitably bonded to the polycarboxylic acids, usually via one or more carbon and/or nitrogen atoms. They are preferably attached to tertiary nitrogen atoms which, in the case of a plurality of nitrogen atoms, are bonded via hydrocarbon chains.

The component of class (K4) is preferably an oil-soluble reaction product based on poly($C_2$- to $C_{20}$-carboxylic acids) which have at least one tertiary amino group and are of the general formula IIa or IIb (IIa)

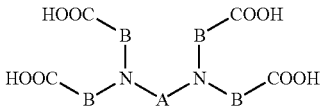

(IIb)

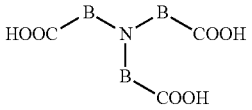

in which the variable A is a straight-chain or branched $C_2$- to $C_6$-alkylene group or the moiety of the formula III (III)

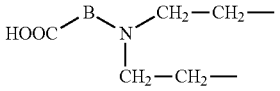

and the variable B is a $C_1$- to $C_{19}$-alkylene group. The compounds of the general formulae IIa and IIb especially have the properties of a WASA.

Moreover, the preferred oil-soluble reaction product of component (K4), especially that of the general formula IIa or IIb, is an amide, an amide-ammonium salt or an ammonium salt in which no, one or more carboxylic acid groups have been converted to amide groups.

Straight-chain or branched $C_2$- to $C_6$-alkylene groups of the variable A are, for example, 1,1-ethylene, 1,2-propylene, 1,3-propylene, 1,2-butylene, 1,3-butylene, 1,4-butylene, 2-methyl-1,3-propylene, 1,5-pentylene, 2-methyl-1,4-butylene, 2,2-dimethyl-1,3-propylene, 1,6-hexylene (hexamethylene) and in particular 1,2-ethylene. The variable A comprises preferably 2 to 4 and especially 2 or 3 carbon atoms.

$C_1$- to $C_{19}$-alkylene groups of the variable B are, for example, 1,2-ethylene, 1,3-propylene, 1,4-butylene, hexamethylene, octamethylene, decamethylene, dodecamethylene, tetradecamethylene, hexadecamethylene, octadecamethylene, nonadecamethylene and especially methylene. The variable B comprises preferably 1 to 10 and especially 1 to 4 carbon atoms.

The primary and secondary amines as a reaction partner for the polycarboxylic acids to form component (K4) are typically monoamines, especially aliphatic monoamines. These primary and secondary amines may be selected from a multitude of amines which bear hydrocarbon radicals which may optionally be bonded to one another.

These parent amines of the oil-soluble reaction products of component (K4) are usually secondary amines and have the general formula $HN(R^8)_2$ in which the two variables $R^8$ are each independently straight-chain or branched $C_{10}$- to $C_{30}$-alkyl radicals, especially $C_{14}$- to $C_{24}$-alkyl radicals. These relatively long-chain alkyl radicals are preferably straight-chain or only slightly branched. In general, the secondary amines mentioned, with regard to their relatively long-chain alkyl radicals, derive from naturally occurring fatty acid and from derivatives thereof. The two $R^8$ radicals are preferably identical.

The secondary amines mentioned may be bonded to the polycarboxylic acids by means of amide structures or in the form of the ammonium salts; it is also possible for only a portion to be present as amide structures and another portion as ammonium salts. Preferably only few, if any, free acid groups are present. The oil-soluble reaction products of component (K4) are preferably present completely in the form of the amide structures.

Typical examples of such components (K4) are reaction products of nitrilotriacetic acid, of ethylenediaminetetraacetic acid or of propylene-1,2-diaminetetraacetic acid with in each case 0.5 to 1.5 mol per carboxyl group, especially 0.8 to 1.2 mol per carboxyl group, of dioleylamine, dipalmitinamine, dicoconut fatty amine, distearylamine, dibehenylamine or especially ditallow fatty amine. A particularly preferred component (K4) is the reaction product of 1 mol of ethylenediaminetetraacetic acid and 4 mol of hydrogenated ditallow fatty amine.

Further typical examples of component (K4) include the N,N-dialkylammonium salts of 2-N',N'-dialkylamidobenzoates, for example the reaction product of 1 mol of phthalic anhydride and 2 mol of ditallow fatty amine, the latter being hydrogenated or unhydrogenated, and the reaction product of 1 mol of an alkenylspirobislactone with 2 mol of a dialkylamine, for example ditallow fatty amine and/or tallow fatty amine, the last two being hydrogenated or unhydrogenated.

Further typical structure types for the component of class (K4) are cyclic compounds with tertiary amino groups or condensates of long-chain primary or secondary amines with carboxylic acid-containing polymers, as described in WO 93/18115.

Sulfocarboxylic acids, sulfonic acids or derivatives thereof which are suitable as cold flow improvers of class (K5) are, for example, the oil-soluble carboxamides and carboxylic esters of ortho-sulfobenzoic acid, in which the sulfonic acid function is present as a sulfonate with alkyl-substituted ammonium cations, as described in EP-A 261 957.

Poly(meth)acrylic esters suitable as cold flow improvers of class (K6) are either homo- or copolymers of acrylic and methacrylic esters. Preference is given to copolymers of at least two different (meth)acrylic esters which differ with regard to the esterified alcohol. The copolymer optionally comprises another different olefinically unsaturated monomer in copolymerized form. The weight-average molecular weight of the polymer is preferably 50 000 to 500 000. A particularly preferred polymer is a copolymer of methacrylic acid and methacrylic esters of saturated $C_{14}$ and $C_{15}$ alcohols, the acid groups having been neutralized with hydrogenated tallamine. Suitable poly(meth)acrylic esters are described, for example, in WO 00/44857.

The cold flow improver or the mixture of different cold flow improvers is added to the middle distillate fuel or diesel fuel in a total amount of preferably 10 to 5000 ppm by weight, more preferably of 20 to 2000 ppm by weight, even more preferably of 50 to 1000 ppm by weight and especially of 100 to 700 ppm by weight, for example of 200 to 500 ppm by weight.

B4) Lubricity Improvers

Suitable lubricity improvers or friction modifiers are based typically on fatty acids or fatty acid esters. Typical examples are tall oil fatty acid, as described, for example, in WO 98/004656, and glyceryl monooleate. The reaction products, described in U.S. Pat. No. 6,743,266 B2, of natural or synthetic oils, for example triglycerides, and alkanolamines are also suitable as such lubricity improvers.

B5) Corrosion Inhibitors

Suitable corrosion inhibitors are, for example, succinic esters, in particular with polyols, fatty acid derivatives, for example oleic esters, oligomerized fatty acids, substituted ethanolamines, and products sold under the trade name RC 4801 (Rhein Chemie Mannheim, Germany) or HiTEC 536 (Ethyl Corporation).

B6) Demulsifiers

Suitable demulsifiers are, for example, the alkali metal or alkaline earth metal salts of alkyl-substituted phenol- and naphthalenesulfonates and the alkali metal or alkaline earth metal salts of fatty acids, and also neutral compounds such as alcohol alkoxylates, e.g. alcohol ethoxylates, phenol alkoxylates, e.g. tert-butylphenol ethoxylate or tert-pentylphenol ethoxylate, fatty acids, alkylphenols, condensation products of ethylene oxide (EO) and propylene oxide (PO), for example including in the form of EO/PO block copolymers, polyethyleneimines or else polysiloxanes.

B7) Dehazers

Suitable dehazers are, for example, alkoxylated phenol-formaldehyde condensates, for example the products available under the trade names NALCO 7D07 (Nalco) and TOLAD 2683 (Petrolite).

B8) Antifoams

Suitable antifoams are, for example, polyether-modified polysiloxanes, for example the products available under the trade names TEGOPREN 5851 (Goldschmidt), Q 25907 (Dow Corning) and RHODOSIL (Rhone Poulenc).

B9) Cetane Number Improvers

Suitable cetane number improvers are, for example, aliphatic nitrates such as 2-ethylhexyl nitrate and cyclohexyl nitrate and peroxides such as di-tert-butyl peroxide.

B10) Antioxidants

Suitable antioxidants are, for example substituted phenols, such as 2,6-di-tert-butylphenol and 6-di-tert-butyl-3-methylphenol, and also phenylenediamines such as N,N'-di-sec-butyl-p-phenylenediamine.

B11) Metal Deactivators

Suitable metal deactivators are, for example, salicylic acid derivatives such as N,N'-disalicylidene-1,2-propanediamine.

B12) Solvents

Suitable solvents are, for example, nonpolar organic solvents such as aromatic and aliphatic hydrocarbons, for example toluene, xylenes, white spirit and products sold under the trade names SHELLSOL (Royal Dutch/Shell Group) and EXXSOL (ExxonMobil), and also polar organic solvents, for example, alcohols such as 2-ethylhexanol, decanol and isotridecanol. Such solvents are usually added to the diesel fuel together with the aforementioned additives and coadditives, which they are intended to dissolve or dilute for better handling.

C) Fuels

The inventive additive is outstandingly suitable as a fuel additive and can be used in principle in any fuels. It brings about a whole series of advantageous effects in the operation of internal combustion engines with fuels. Preference is given to using the inventive quaternized additive in middle distillate fuels, especially diesel fuels.

The present invention therefore also provides fuels, especially middle distillate fuels, with a content of the inventive quaternized additive which is effective as an additive for achieving advantageous effects in the operation of internal combustion engines, for example of diesel engines, especially of direct-injection diesel engines, in particular of diesel engines with common-rail injection systems. This effective content (dosage) is generally 10 to 5000 ppm by weight, preferably 20 to 1500 ppm by weight, especially 25 to 1000 ppm by weight, in particular 30 to 750 ppm by weight, based in each case on the total amount of fuel.

Middle distillate fuels such as diesel fuels or heating oils are preferably mineral oil raffinates which typically have a boiling range from 100 to 400° C. These are usually distillates having a 95% point up to 360° C. or even higher. These may also be so-called "ultra low sulfur diesel" or "city diesel", characterized by a 95% point of, for example, not more than 345° C. and a sulfur content of not more than 0.005% by weight or by a 95% point of, for example, 285° C. and a sulfur content of not more than 0.001% by weight. In addition to the mineral middle distillate fuels or diesel fuels obtainable by refining, those obtainable by coal gasification or gas liquefaction ["gas to liquid" (GTL) fuels] or by biomass liquefaction ["biomass to liquid" (BTL) fuels] are also suitable. Also suitable are mixtures of the aforementioned middle distillate fuels or diesel fuels with renewable fuels, such as biodiesel or bioethanol.

The qualities of the heating oils and diesel fuels are laid down in detail, for example, in DIN 51603 and EN 590 (cf. also Ullmann's Encyclopedia of Industrial Chemistry, 5th edition, Volume A12, p. 617 ff.).

In addition to the use thereof in the abovementioned middle distillate fuels of fossil, vegetable or animal origin, which are essentially hydrocarbon mixtures, the inventive quaternized additive can also be used in mixtures of such middle distillates with biofuel oils (biodiesel). Such mixtures are also encompassed by the term "middle distillate fuel" in the context of the present invention. They are commercially available and usually comprise the biofuel oils in minor amounts, typically in amounts of 1 to 30% by weight, especially of 3 to 10% by weight, based on the total amount of middle distillate of fossil, vegetable or animal origin and biofuel oil.

Biofuel oils are generally based on fatty acid esters, preferably essentially on alkyl esters of fatty acids which derive from vegetable and/or animal oils and/or fats. Alkyl esters are typically understood to mean lower alkyl esters, especially $C_1$-$C_4$-alkyl esters, which are obtainable by transesterifying the glycerides which occur in vegetable and/or animal oils and/or fats, especially triglycerides, by means of lower alcohols, for example ethanol or in particular methanol ("FAME"). Typical lower alkyl esters based on vegetable and/or animal oils and/or fats, which find use as a biofuel oil or components thereof, are, for example, sunflower methyl ester, palm oil methyl ester ("PME"), soya oil methyl ester ("SME") and especially rapeseed oil methyl ester ("RME").

The middle distillate fuels or diesel fuels are more preferably those having a low sulfur content, i.e. having a sulfur content of less than 0.05% by weight, preferably of less than 0.02% by weight, more particularly of less than 0.005% by weight and especially of less than 0.001% by weight of sulfur.

Useful gasoline fuels include all commercial gasoline fuel compositions. One typical representative which shall be mentioned here is the Eurosuper base fuel to EN 228, which is customary on the market. In addition, gasoline fuel compositions of the specification according to WO 00/47698 are also possible fields of use for the present invention.

The inventive quaternized additive is especially suitable as a fuel additive in fuel compositions, especially in diesel fuels, for overcoming the problems outlined at the outset in direct-injection diesel engines, in particular in those with common-rail injection systems.

The invention is now illustrated in detail by the working examples which follow. The test methods described herein are not restricted to the specific working examples, but are part of the general disclosure of the description and can be employed generally in the context of the present invention.

Experimental Section

A. General Test Methods

Engine Test b1) XUD9 Test—Determination of Flow Restriction

The procedure was according to the standard stipulations of CEC F-23-01.

b2) DW10—Keep Clean Test

To examine the influence of the inventive compounds on the performance of direct-injection diesel engines, the power loss was determined on the basis of the official test method CEC F-098-08. The power loss is a direct measure of formation of deposits in the injectors.

The keep clean test is based on CEC test procedure F-098-08 Issue 5. The same test setup and engine type (PEUGEOT DW10) as in the CEO procedure are used.

Special features of the test used:

a) Injectors in the tests, cleaned injectors were used. The cleaning time in an ultrasound bath in water at 60° C.+10% Superdecontamine (Intersciences, Brussels) was 4 h.

b) Test Run Times the test period was 12 h without shutdown phases. The one-hour test cycle (see table below) from CEC F-098-08 was run through 12 times.

| Stage | Duration (minutes) | Engine speed (rpm) +/− 20 | Load (%) | Torque (Nm) +/− 5 | Charge air temperature downstream of charge run cooler (° C.) +/− 3 |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 25 | 43** |
| 8 | 7 | 3000 | 100 | * | 50 |
| 9 | 2 | 1250 | (10) | 25 | 43** |
| 10 | 10 | 2000 | 100 | * | 50 |
| 11 | 2 | 1250 | (10) | 25 | 43** |
| 12 | 7 | 4000 | 100 | * | 50 |
| | Σ = 1 h | | | | |

* for range to be expected see CEC-098-08

** target value c) Power Determination

The initial power ($P_0$, KC [kW]) is calculated from the measured torque at full load 4000/min directly after the test has started and the engine has warmed up. The procedure is described in Issue 5 of the test procedure CEC F-98-08. The same test setup and the PEUGEOT DW10 engine type are used.

The final power ($P_{end}$, KC) is determined in the 12th cycle in stage 12, (see table above). Here too, the operating point is full load 4000/min. $P_{end}$, KC [kW] is calculated from the measured torque.

The power loss in KC is calculated as follows:

$$\text{power loss},KC[\%]=(1-P_{end},KC/P_0,KC)\times 100$$

The fuel used was a commercial diesel fuel from Haltermann (RF-06-03). To synthetically induce the formation of deposits at the injectors, 1 ppm of zinc was added thereto in the form of a zinc neodecanoate solution.

B. Preparation Examples

Reactants Used:

PIBSA: Prepared from maleic anhydride and PIB 1000 in a known manner. For the inventive preparation examples and comparative examples which follow, qualities with hydrolysis numbers in the region of 84-95 mg KOH/g were used. DMAPA was used with the particular PIBSA quality in a molar ratio of 1:1 according to the hydrolysis number. The PIBSA qualities used had bismaleation levels (BML) of less than 15%.

DMAPA: M=102.18 methyl salicylate: M=152.14 dimethyl phthalate: M=194.19 dimethyl oxalate: M=118.09 dimethyl sulfate: M=126.13 dimethyl carbonate M=90.08

Preparation Example 1: Synthesis of an Inventive Quaternized Succinimide (PIBSA/DMAPA/Dimethyl Phthalate)

Polyisobutylenesuccinic anhydride (1659 g) is dissolved in Solvent Naphtha Heavy (SNH, Exxon Mobil, CAS64742-95-5) (1220 g), and 3-dimethylamino-1-propylamine (DMAPA; 153 g) is added. The reaction solution is stirred at 170° C. for 8 h, in the course of which water of condensation formed is distilled off continuously. This affords the PIBSA-DMAPA succinimide as a solution in Solvent Naphtha Heavy (TBN 0.557 mmol/g).

A portion of this solution of the PIBSA-DMAPA succinimide (181 g) is added to dimethyl phthalate (19.4 g), and the resulting reaction solution is stirred at 120° C. for 11 h and then at 150° C. for 24 h. After cooling to room temperature, the product obtained is the ammonium carboxylate as a solution in Solvent Naphtha Heavy. $^1$H NMR analysis confirms the quaternization.

Preparation Example 2: Synthesis of an Inventive Quaternized Succinimide (PIBSA/DMAPA/Methyl Salicylate)

Polyisobutylenesuccinic anhydride (PIBSA; 2198 g) is heated to 110° C., and 3-dimethylamino-1-propylamine (DMAPA; 182 g) is added within 40 min, in the course of which the reaction mixture heats up to 140° C. The reaction mixture is heated to 170° C. and held at this temperature for 3 h, in the course of which 28 g of distillate are collected. This affords the PIBSA-DMAPA succinimide as a viscous oil (TBN 0.735 mmol/g).

A mixture of this PIBSA-DMAPA succinimide (284.5 g), methyl salicylate (65.5 g) (i.e. about 2 equivalents of methyl salicylate per equivalent of tertiary amino group) and 3,3,5-trimethylheptanoic acid (from BASF) (0.75 g) is heated to 140-150° and the reaction mixture is stirred at this temperature for 6 h. After cooling to room temperature, the product obtained is the ammonium salicylate as a viscous oil. $^1$H NMR analysis confirms the quaternization. By adding Pilot 900 oil, Petrochem Carless Ltd., the active ingredient content of the solution is adjusted to 50% by weight.

Preparation Example 3: Synthesis of an Inventive Quaternized Succinimide (PIBSA/DMAPA/Dimethyl Oxalate)

Polyisobutylenesuccinic anhydride (PIBSA; 2198 g) is heated to 110° C., and 3-dimethylamino-1-propylamine (DMAPA; 182 g) is added within 40 min, in the course of which the reaction mixture heats up to 140° C. The reaction mixture is heated to 170° C. and held at this temperature for 3 h, in the course of which 28 g of distillate are collected. This affords the PIBSA-DMAPA succinimide as a viscous oil (TBN 0.735 mmol/g).

A mixture of this PIBSA-DMAPA succinimide (211 g), dimethyl oxalate (34.5 g) and lauric acid (4.9 g) is heated to 120° C. and then stirred at this temperature for 4 h. Excess dimethyl oxalate is removed on a rotary evaporator under reduced pressure (p=5 mbar) at 120° C. The product obtained is the ammonium methyl oxalate as a viscous oil. $^1$H NMR analysis confirms the quaternization.

For comparison with the prior art, Examples 2 and 4 from WO 2006/135881 were worked up.

Preparation Example 4: Synthesis of a Known Quaternized Succinimide (Comparative Example) (Example 2 from WO 2006/135881)

A solution of PIBSA (420.2 g) in Pilot 900 oil, Petrochem Carless Ltd., (51.3 g) is initially charged and heated to 110° C. DMAPA (31.4 g) is metered in within 50 minutes, in the course of which a slightly exothermic reaction is observed. Within 80 minutes, the reaction mixture is heated to 150° C. and the mixture is then kept at this temperature for 3 h, in the course of which the water of reaction which forms is distilled off. After cooling to room temperature, the PIBSA-DMAPA succinimide is obtained as a solution in Pilot 900 oil (TBN 0.62 mmol/g).

A portion of the PIBSA-DMAPA succinimide thus obtained as a solution in Pilot 900 oil, Petrochem Carless Ltd., (354 g) is initially charged and heated to 90° C. Dimethyl sulfate (26.3 g) is metered in, in the course of which the reaction temperature rises to 112° C. Subsequently, the reaction mixture is stirred at 100° C. for 3 h. After cooling to room temperature, the quaternized PIBSA-DMAPA succinimide is obtained as a solution in Pilot 900 oil. $^1$H NMR confirmed the quaternization. The output was adjusted to an active ingredient content of 50% by weight by adding Pilot 900 oil.

Preparation Example 5: Synthesis of a Known Quaternized Succinimide (Comparative Example) (Example 4 from WO 2006/135881)

A solution of PIBSA (420.2 g) in Pilot 900 oil, Petrochem Carless Ltd., (51.3 g) is initially charged and heated to 110° C. DMAPA (31.4 g) is metered in within 50 minutes, in the course of which a slightly exothermic reaction is observed. Within 80 minutes, the reaction mixture is heated to 150° C. and the mixture is then kept at this temperature for 3 h, in the course of which the water of reaction which forms is distilled off. After cooling to room temperature, the PIBSA-DMAPA succinimide is obtained as a solution in Pilot 900 oil (TBN 0.62 mmol/g).

A portion of the PIBSA-DMAPA succinimide thus obtained as a solution in Pilot 900 oil, Petrochem Carless Ltd., (130 g), dimethyl carbonate (20 g) and methanol (17.4) are charged into an autoclave and inertized with nitrogen, and a starting pressure of 1.3 bar is established. Subsequently, the reaction mixture is stirred under autogenous pressure first at 90° C. for 1 h, then at 140° C. for 24 h. After cooling to room temperature, the autoclave is decompressed and the contents are rinsed out completely with a little toluene as a solvent. All low-boiling constituents are subsequently removed on a rotary evaporator under reduced pressure to obtain the quaternized PIBSA-DMAPA succinimide as a solution in Pilot 900 oil. $^1$H NMR analysis confirmed the partial quaternization. The output is adjusted to an active ingredient content of 50% by weight by adding Pilot 900 oil.

C. Use Examples

In the use examples which follow, the additives are used either as a pure substance (as synthesized in the above preparation examples) or in the form of an additive package.

M1: Additive according to preparation example 2 (inventive, quaternized with methyl salicylate)

M2: Additive according to preparation example 4 (comparative, quaternized with dimethyl sulfate)

M3: Additive according to preparation example 5 (comparative, quaternized with dimethyl carbonate)

Use Example 1: Determination of the Additive Action on the Formation of Deposits in Diesel Engine Injection Nozzles a) XUD9 Tests Fuel used: RF-06-03 (reference diesel, Haltermann Products, Hamburg)

The results are compiled in table 1:

TABLE 1

XUD9 tests

| Ex. | Name | Dosage according to preparation example [mg/kg] | Flow restriction 0.1 mm needle stroke [%] |
|---|---|---|---|
| #1 | M1, according to preparation example 2 | 30 | 10.7 |
| #2 | M2, according to preparation example 4 | 30 | 48.5 |
| #3 | M3, according to preparation example 5 | 30 | 20.8 |

It was found that the inventive additive M1, with the same dosage, has an improved effect compared to the prior art (M2, M3).

b) DW10 Test

To study the influence of the inventive compound on the performance of direct-injection diesel engines, the power loss was determined based on the official test method CEC F-098-08 as described above. The power loss is a direct measure of formation of deposits in the injectors. A conventional direct-injection diesel engine with a common-rail system was used.

The fuel used was a commercial diesel fuel from Haltermann (RF-06-03). To synthetically induce the formation of deposits at the injectors, 1 ppm by weight of zinc in the form of a zinc didodecanoate solution was added thereto.

The table below shows the results of the determinations of the relative power loss at 4000 rpm after 12 hours of sustained operation without interruption. The value $P_0$ gives the power after 10 minutes and the value $P_{end}$ the power at the end of the measurement:

The test results are shown in table 2.

TABLE 2

Results of the DW10 test

| Additive | Dose [mg/kg] | Time [h] | $P_0$ [KW] | $P_{end}$ [KW] | Power loss |
|---|---|---|---|---|---|
| Base value | 0 | 12 | 99.3 | 94.3 | 5.0% |
| M1, according to preparation example 2 | 160 | 12 | 98.7 | 97.4 | 1.32% |
| M2, according to preparation example 4 | 160 | 12 | 99 | 98.1 | 0.9% |
| M3, according to preparation example 5 | 160 | 12 | 98.1 | 95.7 | 2.4% |

It was found that the inventive additive M1 has an improved effect compared to the base value and has an improved effect at least compared to example M3.

Use Example 2: Determination of the Solubility Properties

To determine the solubility properties, the following additive packages were produced and tested:

M 4 (Inventive)

| Substance | Content [ppm] |
|---|---|
| Additive acc. to preparation example 2 | 160.00 |
| Dehazer, commercial | 3.00 |
| Antifoam, silicone-based, commercial | 6.00 |
| Solvent Naphtha Heavy | 80.00 |
| Total | 249.00 |

M 5 (Comparative, Dimethyl Sulfate)

| Substance | Content [ppm] |
|---|---|
| Additive acc. to preparation example 4 | 160.00 |
| Dehazer, commercial | 3.00 |
| Antifoam, silicone-based, commercial | 6.00 |
| Solvent Naphtha Heavy | 420.00 |
| Total | 589.00 |

M 6 (Comparative, Dimethyl Carbonate)

| Substance | Content [ppm] |
|---|---|
| Additive acc. to preparation example 5 | 160.00 |
| Dehazer (commercial) | 3.00 |
| Antifoam, silicone-based, commercial | 6.00 |
| Solvent Naphtha Heavy | 150.00 |
| Total | 319.00 |

The result of the solubility tests is compiled in the table below. The minimum amount of solvent (Solvent Naphtha Heavy) needed to obtain a homogeneous, clear diesel performance package at room temperature with otherwise identical amounts of active substance, Pilot 900, antifoam and dehazer is reported.

TABLE 3

Determination of the solvent requirement

| Additive | Additive package | Minimum amount of solvent needed for a homogeneous package |
|---|---|---|
| PIBSA-DMAPA-imide-methyl salicylate | M4 | 32% |
| PIBSA-DMAPA-imide-dimethyl sulfate | M5 | 71% |
| PIBSA-DMAPA-imide-dimethyl carbonate | M6 | 47% |

It was found that, surprisingly, the additive according to preparation example 2 has the best solubility properties, i.e. requires the least solvent.

Reference is made explicitly to the disclosure of the publications cited herein.

The invention claimed is:

1. A fuel composition comprising, in a majority amount of a customary fuel, a proportion of at least one reaction product comprising a quaternized nitrogen compound, or a fraction thereof comprising a quaternized nitrogen compound, and being obtained from said reaction product by purification, said reaction product being obtainable by a) reacting a hydrocarbyl-substituted polycarboxylic acid compound with a compound comprising at least one oxygen or nitrogen group capable of addition or condensation or otherwise reactive, with the polycarboxylic acid, and comprising at least one quaternizable amino group, to obtain a quaternizable hydrocarbyl-substituted polycarboxylic acid compound, and b) subsequent reaction thereof with a quaternizing agent which converts the at least one quaternizable amino group to a quaternary ammonium group, said quaternizing agent being the alkyl ester of a cycloaromatic or cycloaliphatic mono- or polycarboxylic acid, or of an aliphatic polycarboxylic acid;

or said reaction product being obtainable by reacting a quaternizable hydrocarbyl-substituted polycarboxylic acid compound comprising at least one quaternizable amino group with a quaternizing agent which converts the at least one quaternizable amino group to a quaternary ammonium group, said quaternizing agent being the alkyl ester of a cycloaromatic or cycloaliphatic mono- or polycarboxylic acid, or of an aliphatic polycarboxylic acid, wherein said compound comprising at least one oxygen or nitrogen group capable of addition or condensation or otherwise reactive, with the polycarboxylic acid, and comprising at least one quaternizable amino group is selected from the group consisting of aromatic or nonaromatic heterocycles having one primary and one tertiary amino group and aromatic or nonaromatic heterocycles having a tertiary amino group and a hydroxyalkyl group.

2. The fuel composition according to claim 1, wherein said aromatic or nonaromatic heterocycles having one primary and one tertiary amino group that is a N-heterocycle which is aminoalkylated on at least one ring nitrogen atom, wherein the N-heterocycle is selected from the group consisting of tetrahydrofuran, pyrrolidine, isoxazolidine, isothiazolidine, pyrazolidine, oxazolidine, thiazolidine, imidazolidine, pyrroline, piperidine, piperidinyl, 1,3-dioxane, tetrahydropyran, hexahydropyridazine, hexahydropyrimidine, piperazine, furan, thiane, pyrrole, pyrazole, oxazole, thiazole, imidazole and 1,3,4-triazole; isoxazole, isothiazole, thiadiazole, oxadiazole, pyridinyl, pyridazine, pyrimidine, pyrazinyl, 1,2,4-triazine, and 1,3,5-triazin-2-yl.

3. The fuel composition according to claim 1, wherein said aromatic or nonaromatic heterocycles having a tertiary amino group and a hydroxyalkyl group is a N-heterocycle which is aminoalkylated on at least one ring nitrogen atom, wherein the N-heterocycle is selected from the group consisting of tetrahydrofuran, pyrrolidine, isoxazolidine, isothiazolidine, pyrazolidine, oxazolidine, thiazolidine, imidazolidine, pyrroline, piperidine, piperidinyl, 1,3-dioxane, tetrahydropyran, hexahydropyridazine, hexahydropyrimidine, piperazine, furan, thiane, pyrrole, pyrazole, oxazole, thiazole, imidazole and 1,3,4-triazole; isoxazole, isothiazole, thiadiazole, oxadiazole, pyridinyl, pyridazine, pyrimidine, pyrazinyl, 1,2,4-triazine, and 1,3,5-triazin-2-yl.

4. The fuel composition according to claim 1, wherein said aromatic or nonaromatic heterocycles having one primary and one tertiary amino group is a N-heterocycles which is aminoalkylated on at least one ring nitrogen atom, wherein the N-heterocycle is selected from the group consisting of furan, thiane, pyrrole, pyrazole, oxazole, thiazole, imidazole and 1,3,4-triazole; isoxazole, isothiazole, thiadiazole, and oxadiazole.

5. The fuel composition according to claim 1, wherein said aromatic or nonaromatic heterocycles having a tertiary amino group and a hydroxyalkyl group is a N-heterocycle which is aminoalkylated on at least one ring nitrogen atom, wherein the N-heterocycle is selected from the group consisting of furan, thiane, pyrrole, pyrazole, oxazole, thiazole, imidazole and 1,3,4-triazole; isoxazole, isothiazole, thiadiazole, and oxadiazole.

6. The fuel composition according to claim 1, wherein said aromatic or nonaromatic heterocycles having one primary and one tertiary amino group is a N-heterocycle which is aminoalkylated on at least one ring nitrogen atom, wherein the N-heterocycle is selected from the group consisting of 1-(3-Aminopropyl)imidazole

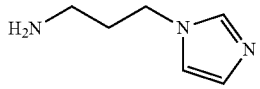

4-(3-Aminopropyl)morpholine

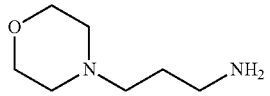

1-(2-Aminoethylpiperidine)

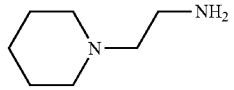

2-(1-Piperazinyl)ethylamine (AEP)

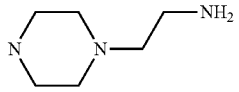

N-Methylpiperazine

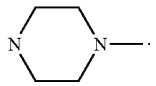

7. The fuel composition according to claim 1, wherein said aromatic or nonaromatic heterocycles having one primary and one tertiary amino group is 1-(3-Aminopropyl)imidazole

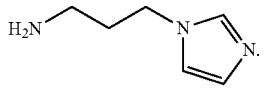

8. The fuel composition according to claim 1, wherein said aromatic or nonaromatic heterocycles having a tertiary amino group and a hydroxyalkyl group is 1-(3-Hydroxypropyl)imidazole

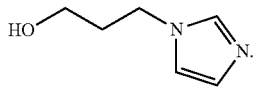

9. The fuel composition according to claim 7, wherein about 1.1 to about 2.0 equivalents of quaternizing agent are used per equivalent of quaternizable tertiary nitrogen atom.

10. The fuel composition according to claim 1, wherein the hydrocarbyl-substituted polycarboxylic acid compound is a polyisobutenylsuccinic acid or an anhydride thereof, said acid having a bismaleation level of less than about 20%.

11. The fuel composition according to claim 1, wherein the quaternizing agent is a compound of the general formula 1

$$R_1OC(O)R_2 \quad (1)$$

in which $R_1$ is a lower alkyl radical and $R_2$ is an optionally substituted monocyclic aryl or cycloalkyl radical, where the substituent is selected from OH, $NH_2$, $NO_2$, $C(O)OR_3$, and $R_1OC(O)$—, in which $R_1$ is as defined above and $R_3$ is H or $R_1$.

12. The fuel composition according to claim 1, wherein the quaternizing agent is a compound of the general formula 2

$$R_1OC(O)\text{-}A\text{-}C(O)OR_{1a} \quad (2)$$

in which $R_1$ and $R_{1a}$ are each independently a lower alkyl radical and

A is hydrocarbylene, such as especially alkylene or alkenylene.

13. The fuel composition according to claim 1, wherein the quaternizing agent is selected from alkyl salicylates, dialkyl phthalates and dialkyl oxalates.

14. The fuel composition according to claim 1, selected from diesel fuels, biodiesel fuels, gasoline fuels and alkanol-containing gasoline fuels.

* * * * *